US006752165B2

(12) United States Patent
Johansson

(10) Patent No.: US 6,752,165 B2
(45) Date of Patent: Jun. 22, 2004

(54) REFINER CONTROL METHOD AND SYSTEM

(75) Inventor: Ola M. Johansson, Brookfield, WI (US)

(73) Assignee: J & L Fiber Services, Inc., Waukesha, WI (US)

( * ) Notice: Subject to any disclaimer, the term of this patent is extended or adjusted under 35 U.S.C. 154(b) by 0 days.

(21) Appl. No.: 09/799,109

(22) Filed: Mar. 6, 2001

(65) Prior Publication Data

US 2001/0044670 A1 Nov. 22, 2001

Related U.S. Application Data

(60) Provisional application No. 60/187,807, filed on Mar. 8, 2000, and provisional application No. 60/190,743, filed on Mar. 20, 2000.

(51) Int. Cl.[7] ..... G05D 21/02; D21D 1/30

(52) U.S. Cl. ..... 137/4; 137/92; 137/624.11; 162/198; 162/258; 162/262; 162/DIG. 10; 241/34; 241/36; 700/128

(58) Field of Search ..... 137/4, 7, 12, 14, 137/88, 92, 93, 624.11; 162/198, 258, 262, DIG. 10, 253, 254; 241/33, 34, 36; 700/128, 282

(56) References Cited

U.S. PATENT DOCUMENTS

| | | | | |
|---|---|---|---|---|
| 1,151,131 | A | | 8/1915 | Starliper |
| 2,116,584 | A | | 5/1938 | Shelby |
| 2,335,358 | A | | 11/1943 | Ray |
| 2,353,444 | A | | 7/1944 | Conradty et al. |
| 2,843,646 | A | | 7/1958 | Conant |
| 3,069,752 | A | | 12/1962 | Sherning |
| 3,091,844 | A | | 6/1963 | Laine |
| 3,309,031 | A | * | 3/1967 | McMahon et al. ..... 241/37 |
| 3,379,578 | A | | 4/1968 | McTaggart et al. |

(List continued on next page.)

FOREIGN PATENT DOCUMENTS

| | | |
|---|---|---|
| CA | 2183700 | 2/1997 |
| CH | 546 600 | 6/1972 |
| DE | 2145096 | 1/1973 |
| EP | 0640395 A1 | 3/1995 |
| FR | 2339703 | 8/1977 |
| GB | 1 468 649 | 12/1975 |
| GB | 28667 | 1/2001 |
| WO | WO 83/01969 | 6/1983 |

(List continued on next page.)

OTHER PUBLICATIONS

W.E. Lunan, K.B. Miles and W.D. May, *The Effect of Differential Pressure on Energy Consumption in Thermo-mechanical Pulping*, Journal of Pulp and Paper Science: vol. 11, No. 5, Sep. 1985, pp. J129–J135.

K.B. Miles and W.D. May, Pulp and Paper Research Institute of Canada, *Predicting the Performance of a Chip Refiner; A Constitutive Approach*, 1991 International Mechanical Pulping Conference, pp. 295–301.

(List continued on next page.)

*Primary Examiner*—Ramesh Krishnamurthy
(74) *Attorney, Agent, or Firm*—Boyle, Fredrickson, Newholm, Stein & Gratz, S.C.

(57) ABSTRACT

A system and method for monitoring and control operation of a rotary disk refiner. The method regulates refiner operation in response to a process variable preferably in relation to a setpoint. The variable can be temperature, pressure, and/or stock consistency, refiner energy, or a variable based thereon. Volumetric flow rate of stock and/or the flow rate of dilution water can be regulated. Based on a refiner temperature, pressure, and/or stock consistency, refiner energy, or a variable based thereon, the flow rate of stock and/or dilution water can be regulated. Where temperature is used, it preferably can be a temperature inside the refiner or adjacent the inlet or outlet. Where pressure is used, it preferably can be a pressure inside the refiner or adjacent the inlet or outlet. Stock consistency can be determined using a sensor upstream or downstream of the refiner or using a sensed parameter in the refiner.

51 Claims, 19 Drawing Sheets

U.S. PATENT DOCUMENTS 3,466,200 A 9/1969 Mellor et al.
3,539,400 A 11/1970 Pustell
3,553,827 A 1/1971 Baker et al.
3,604,645 A 9/1971 Keyes, IV
3,617,006 A * 11/1971 Jones ..... 241/21
3,617,717 A 11/1971 Smith
3,650,891 A 3/1972 Dahlin
3,711,687 A * 1/1973 Stout et al. ..... 162/258
3,847,359 A 11/1974 Holmes et al.
3,867,205 A 2/1975 Schley
3,947,668 A 3/1976 Al-Shaikh et al.
4,023,739 A 5/1977 Lampe et al.
4,060,716 A 11/1977 Pekrul et al.
4,070,761 A 1/1978 Collins
4,071,451 A 1/1978 Wood
4,148,439 A * 4/1979 Floden ..... 241/28
4,184,204 A * 1/1980 Flohr ..... 162/254
4,211,324 A 7/1980 Ohlbach
4,227,927 A 10/1980 Black et al.
4,268,381 A 5/1981 Hooper
4,313,465 A 2/1982 Holzem et al.
4,314,878 A 2/1982 Lee
4,430,221 A 2/1984 Spiewok
4,454,991 A 6/1984 Brenholdt
4,498,137 A 2/1985 Flohr
4,581,300 A 4/1986 Hoppin
4,581,813 A 4/1986 Terhune
4,582,568 A * 4/1986 Iyengar ..... 100/117
4,587,707 A 5/1986 Nishida et al.
4,614,296 A 9/1986 Lesgourgues
4,626,318 A * 12/1986 Prough et al. ..... 162/254
4,627,578 A 12/1986 Whyte
4,661,911 A * 4/1987 Ellery, Sr. ..... 162/254
4,670,215 A 6/1987 Morishita et al.
4,672,529 A 6/1987 Kupersmit
4,673,875 A 6/1987 Kjellqvist et al.
4,688,726 A 8/1987 Brenholdt
4,730,252 A 3/1988 Bradshaw
4,745,254 A 5/1988 Funk
4,820,980 A 4/1989 Dodson-Edgars
4,837,417 A 6/1989 Funk
4,858,103 A 8/1989 Takeuchi et al.
4,878,020 A 10/1989 Kärnä et al.
4,887,208 A 12/1989 Schneider et al.
4,920,488 A 4/1990 Filley
4,943,347 A * 7/1990 Floden ..... 162/253
4,950,986 A 8/1990 Guerrero
4,972,318 A 11/1990 Brown et al.
4,980,123 A 12/1990 Gedeon et al.
4,994,971 A 2/1991 Poelstra
5,007,985 A 4/1991 Engstrand et al.
5,009,774 A 4/1991 LeBlanc
5,011,065 A 4/1991 Musselmann
5,011,088 A 4/1991 Savonjousi
5,011,090 A 4/1991 Savonjousi
5,016,824 A * 5/1991 Pietinen et al. ..... 241/161
5,042,726 A 8/1991 Reinhall
5,063,380 A 11/1991 Wakura
5,064,536 A 11/1991 Bratten
5,067,660 A 11/1991 Reinhall
5,071,514 A 12/1991 Francis
5,081,039 A 1/1992 Buttke et al.
5,091,713 A 2/1992 Horne et al.
5,233,542 A 8/1993 Hohner et al.
5,425,508 A 6/1995 Chaney
5,445,328 A 8/1995 Musselman
5,491,340 A 2/1996 Saarinen
5,500,088 A * 3/1996 Allison et al. ..... 162/198
5,500,735 A 3/1996 Bentley et al.
5,544,819 A 8/1996 Shepherd
5,555,171 A 9/1996 Sonehara et al.
5,581,019 A 12/1996 Minor et al.
5,586,305 A 12/1996 Eidson et al.
5,600,058 A 2/1997 Preikschat et al.
5,601,690 A 2/1997 Gauld et al.
5,638,284 A 6/1997 Helmer et al.
5,666,493 A 9/1997 Wojcik et al.
5,680,320 A 10/1997 Helmer et al.
5,682,473 A 10/1997 Carson et al.
5,684,247 A 11/1997 Preikschat
5,687,098 A 11/1997 Grumstrup et al.
5,691,636 A 11/1997 Allshouse et al.
5,718,389 A 2/1998 Finken et al.
5,745,365 A 4/1998 Parker
5,747,707 A * 5/1998 Johansson et al. ..... 241/261.3
5,758,329 A 5/1998 Wojcik et al.
5,823,453 A 10/1998 Garasimowicz
5,825,653 A 10/1998 Huovila et al.
5,966,679 A 10/1999 Snowbarger et al.
5,975,438 A 11/1999 Garasimowicz
5,991,636 A 11/1999 Won et al.
6,024,309 A 2/2000 Karlström
6,092,003 A 7/2000 Hagart-Alexander et al.
D431,826 S 10/2000 Karlström
6,157,916 A 12/2000 Hoffman
6,200,421 B1 * 3/2001 Meinander ..... 162/198
6,206,309 B1 3/2001 Danielsson et al.
6,290,816 B1 * 9/2001 Graf ..... 162/198
6,314,381 B1 11/2001 Johansson
6,317,701 B1 11/2001 Pyotsia et al.
6,324,490 B1 11/2001 Johansson et al.
6,502,774 B1 1/2003 Johansson et al.
2001/0032898 A1 10/2001 Bankes et al.
2002/0013635 A1 1/2002 Gotou et al.

FOREIGN PATENT DOCUMENTS

WO WO 96/14156 5/1996
WO WO 97/23018 6/1997
WO WO 97/24596 7/1997
WO WO 97/38792 10/1997
WO WO 98/48936 11/1998
WO WO 98/58243 12/1998

OTHER PUBLICATIONS

H.R. Dana, W.D. May, K.B. Miles and B.G. Newman, Pulp and Paper Research Institute of Canada, Pointe Claire, P.Q., *A Study of Steam Flow and Self–Pressurization in Chip Refiners*, Transactions, vol. 1, No. 3, Sep. 1975, pp. 82–88.

K.B. Miles and W.D. May, Pulp and Paper Research Institute of Canada 1989 Annual Meeting, *The Flow of Pulp in Chip Refiners*, pp. A177–A188.

William Herbert and P.G. Marsh, *Mechanics and Fluid Dynamics of a Disk Refiner*, Tappi, vol. 51, No. 5, May 1968, pp. 235–239.

A Master's thesis by Alexander Horch, *Modeling and Control of a Thermo Mechanical Pulp Refiner*, Dec. 7, 1995.

Helmut Becker, Hans Höglund and Göran Tistad, *Frequency and temperature in chip refining*, Paperi ja Puu–Papper och Trä, No. 3, 1977.

D. Atack and M.I. Stationwala, Pulp and Paper Research Institute of Canada, *On the Measurement of Temperature and Pressure in the Refining Zone of an Open Discharge Refiner*, Transactions, vol. 1, No. 3, pp. 71–76, Sep. 1975.

Esko Härkönen, Seppo Ruottu, Ari Ruotu and Ola Johansson, *A Theoretical Model for a TMP–Refiner*, Jun. 9–13, 1997, pp. 95–102, 1997 International Pulping Conference, Stockholm, Sweden.

B.G. Newman, M.I. Stationwala and D. Atack, Pulp and Paper Research Institute of Canada, *Analysis of Steam Flow in Disc Refining*, SPCI International Mechanical Pulping Conference, May 6–10, 1985, pp. 60–67.

Per A Gradin, Ola Johansson, Jan–Erik Berg and Staffan Syström, *Measurement of the Power Distribution in a Single Disc Refiner*, J. Pulp Paper Science 25, No. 11:384–387 (1999).

M.I. Stationwala, D. Atack, J.R. Wood, D.J. Wild, and A. Karnis, Pulp and Paper Research Institute of Canada, *The Effect of Control Variables on Refining Zone Conditions and Pulp Properties*, Pap. Puu 73, No. 1: 62–69 (Jan. 1991).

Marc. J. Sabourin, Eric Xu, j. Brad Cort, Ivan Boileau and Andrew Waller, *Optimizing Residence Time, Temperature and Speed to Improve TMP Pulp Properties and Reduce Energy*, Pulp Pap. Can. 98, No. 4: 38–45, Apr. 1997.

K.B. Miles, H.R. Dana and W.D. May, *The Flow of Steam in Chip Refiners*, CCPA Conf. Technol. E. Stivale 55–60 (Jun. 2–5, 1982), pp. 30–42.

Ola Johansson, Mark Frith, Bo Falk and Robert Gareau, *Thermopulp®—Recent Process Developments and Experiences*, 84$^{th}$ Annual Meeting of the Technical Section of the CCPA: Papers Presented Jan. 29–30, 1998, pp. 1–11.

OMEGA Thermocouple Calibrator Handbook (1996).

Ali P. Haapanen, Pulp and Paper Technical Association of Canada 86$^{th}$ Annual Meeting Papers (2000), *On–Line Temperature Measurement for Paper Machine Dryers: A New Way to Monitor and Improve Performance*, pp. B81–B84.

83$^{rd}$ Annual Meeting, Technical Section, Canadian Pulp & Paper Association, Papers Presented on Tuesday and Wednesday, Jan. 28–29, 1997, Preprints A, *Electronic Customer Data Management System*, pp. A53–A56.

Omegadyne™ Pressure, Force, Load Torque Databook (1996), *Chapters B, C, D, E, F, G, H, and J*.

Bill Gough, John Kay, and Greg Seebach, Canadian Pulp & Paper Association, Technical Section, 79$^{th}$ Annual Meeting, Preprints A, *Adaptive Control Applications in Pulp and Paper*, pp. A73–A84, Jan. 26–27, 1993.

Luc Charbonneau and Philip Plouffe, Canadian Pulp & Paper Association, Technical Section, 79$^{th}$ Annual Meeting, Preprints A, *Sensodec–10—Condition Monitoring System*, pp. A109–A118, Jan. 26–27, 1993.

M. Spence, K. Danielson, Y. Ying, and M. Rao, Canadian Pulp & Paper Association, Technical Section, 79$^{th}$ Annual Meeting, Preprints A, *On–Line Advisory Expert System Development at Daishowa Peace River Pulp*, pp. A143–A147, Jan. 26–27, 1993.

Geoff Lawrence, Canadian Pulp & Paper Association, Technical Section, 79$^{th}$ Annual Meeting, Preprints A, *New Measurement and Control System Allows for Simple and Economical DCS Integration*, pp. A179–A183, Jan. 26–27, 1993.

James J. Pinto and Pierre Gingras, Canadian Pulp & Paper Association, Technical Section, 79$^{th}$ Annual Meeting, Preprints A, *"Truly" Distributed Control Systems—Through Intelligent, Networked I/O*, pp. A291–A294, Jan. 26–27, 1993.

John R. Lavigne, Pulp and Paper Industry Division, *An Introduction to Paper Industry Instrumentation, Revised Edition*, 1977, Chapters 1, 2, 4, 5, 6, 7, 8, 10, 11, 12, 15, 16, 17, 18, 19 and 20.

B.C. Strand and Anders Mokvist, 1991 Int'l Mech. Pulping Conf. Proc., Jun. 2–5, *On–Line Control and Optimization of the Refining Process Using a Model Based Control System*, pp. 101–108.

Jan Hill, Kari Saarinen, and Roger Stenros, 1991 Int'l Mech. Pulping Conf. Proc., Jun. 2–5, *On the control of chip refining systems*, pp. 235–241.

Kenneth W. Britt, Ed., *Handbook of Pulp and Paper Technology*, 2$^{nd}$ Ed. (1970), Chapter 5.

M. Fournier, H. Ma, P.M. Shallhorn, and A.A. Roche, *Control of Chip Refiner Operation*, 1991 Int'l Mech. Pulping Conf. Proc., pp. 91–100.

Daniel Jutras, Steve A. Rowland, Luis Cortez, and Nelson LaFleur, *The Hymac HXD–64: A New Concept in Refiner Design*, 1991 Int'l Mech. Pulping Conf. Proc., pp. 285–294.

M.I. Stationwala, K.B. Miles, and A. Karnis, *The Effect of First Stage Refining Conditions on Pulp Properties and Energy Consumption*, 1991 Int'l Mech. Pulping Conf. Proc., pp. 321–327.

Art. Jepson, New Wave Screen Baskets Upgrade Existing Systems, 1984 Pulping Conf. TAPPI Proc., pp. 515–520.

OMEGA *C01, C02, C03 "Cement–On" Thermocouples User's Guide* (1996).

Lars Johansson, *Effects of Temperature and Sulfonation on Deformation of Spruce Wood*, Thesis for Dept. of Forest Prods. and Chem. Eng'g, Chalmers University of Technology, Göteborg, Sweden (1997).

OMEGA *Transactions in Measurement and Control*, vol. 3: Force–Related Measurements (1998).

Karin Eriksson, Performance Analysis in TMP Refining, Thesis for Dept. of Signals and Systems, Chalmers University of Technology, Göteborg, Sweden (2001).

BeInZero AB Refiner Control System documentation, "Get to Know Your Refiners", pp. 1–19 and appendices 1 and 2 (2000).

Jan Sundholm, *Papermaking Science and Technology, Book 5: Mechanical Pulping* (1999), chapters 1–4 and 7–10.

Lydia Bley and Roland Berger, *Recent Advances in On–Line Charge Measurements*, 2001 Int'l Mech. Pulping Conf. Proc, pp. 63–72.

François Julien Saint Amand and Bernard Perrin, *Fundamental Aspects of Mechanical Pulp Screening*, 2001 Int'l Mech. Pulping Conf. Proc, pp. 387–406.

B.C. Strand, View on Control Development, 2001 Int'l Mech. Pulping Conf. Proc, pp. 477–480.

Karl Mosbye, Kjell–Arve Kure, Guri Fuglem, Ola Johansson, *Use of Refining Zone Temperature Measurements for Refiner Control*, 2001 Int'l Mech. Pulping Conf. Proc., pp. 481–488.

Olof Ferritsius and Rita Ferritsius, *Experiences from Stora Enso Mills of Using Factor Analysis for Control of Pulp and Paper Quality*, 2001 Int'l Mech. Pulping Conf. Proc., pp. 495–503.

Juha Kortelainen, Anitti Salopuro, Jouko Halttunen, *Prediction of TMP Quality Properties with On–Line Measurements*, 2001 Int'l Mech. Pulping Conf. Proc., pp. 505–512.

Ismo Joensuu, Lennart Karlsson, Jaakko Myllyneva, *Fuzzy Quality Control of a TMP Plant*, 2001 Int'l Mech. Pulping Conf. Proc., pp. 513–521.

Lars Sundström, Roy Tönnesen, and Lennart Nilsson, *Multivariate Monitoring of a Chip Feeding Process*, 2001 Int'l Mech. Pulping Conf. Proc., pp. 523–529.

Petteri Vuorio and Peter Bergquist, *New Refiner Segments Technology to Optimize Fiber Quality and Energy Consumption of Refiner Mechanical Pulp*, 2001 Int'l Mech. Pulping Conf. Proc., pp. 565–577.

Ola Johansson, Dan Hogan, Dale Blankenship, Eddie Snow, Wyllys More, Ronnie Qualls, Keith Pugh, and Mike Wanderer, *Improved Process Optimization Through Adjustable Refiner Plates*, 2001 Int'l Mech. Pulping Conf. Proc., pp. 579–589.

Fredrik Rosenqvist, Karin Eriksson, and Anders Karlström, *Time–Variant Modelling of TMP Refining* (undated).

Fredrik Rosenqvist, Karin Eriksson, and Anders Karlström, *Modelling a Thermomechanical Wood–Chip Refiner* (undated).

Plant Information (PI™) System brochure, OSI Software Inc. (undated).

* cited by examiner

REFINER CONTROL METHOD AND SYSTEM

CROSS-REFERENCE TO RELATED APPLICATIONS

This application claims priority under 35 U.S.C. §119(e) to U.S. Provisional Patent Application No. 60/187,807, filed Mar. 8, 2000, and U.S. Provisional Patent Application No. 60/190,743, filed Mar. 20, 2000, the entirety of both which are incorporated by reference herein.

FIELD OF THE INVENTION

The present invention relates to a method and system for controlling operation of a rotary disk refiner that processes fiber. In particular, the invention relates to a method and system of regulating operation of a rotary disk refiner in response to a refiner process variable preferably in response to a set point.

BACKGROUND OF THE INVENTION

Many products we use every day are made from fibers. Examples of just a few of these products include paper, personal hygiene products, diapers, plates, containers, and packaging. Making products from wood fibers, cloth fibers and the like, involves breaking solid matter into fibrous matter. This also involves processing the fibrous matter into individual fibers that become fibrillated or frayed so they more tightly mesh with each other to form a finished fiber product that is desirably strong, tough, and resilient.

In fiber product manufacturing, refiners are devices used to process the fibrous matter, such as wood chips, pulp, fabric, and the like, into fibers and to further fibrillate existing fibers. The fibrous matter is transported in a liquid stock slurry to each refiner using a feed screw driven by a motor. Each refiner has at least one pair of circular ridged refiner discs that face each other. During refining, fibrous matter in the stock to be refined is introduced into a gap between the discs that usually is quite small. Relative rotation between the discs during operation causes the fibrous matter to be fibrillated as the stock passes radially outwardly between the discs.

One example of a refiner that is a disc refiner is shown and disclosed in U.S. Pat. No. 5,425,508. However, many different kinds of refiners are in use today. For example, there are counterrotating refiners, double disc or twin refiners, and conical disc refiners. Conical disc refiners are often referred to in the industry as CD refiners.

Each refiner has at least one motor coupled to a rotor carrying at least one of the refiner discs. During operation, the load on this motor can vary greatly over time depending on many parameters. For example, as the mass flow rate of the stock slurry being introduced into a refiner increases, the load on the motor increases. It is also known that the load on the motor will decrease as the flow rate of dilution water is increased.

During refiner operation, a great deal of heat is produced in the refining zone between each pair of opposed refiner discs. The refining zone typically gets so hot that steam is produced, which significantly reduces the amount of liquid in the refining zone. This reduction of liquid in the refining zone leads to increased friction between opposed refiner discs, which increases the load on the motor of the refiner. When it becomes necessary to decrease this friction, water is added to the refiner. The water that is added is typically referred to as dilution water.

One problem that has yet to be adequately solved is how to control refiner operation so that the finished fiber product has certain desired characteristics that do not vary greatly over time. For example, paper producers have found it very difficult to consistently control refiner operation from one hour to the next so that a batch of paper produced has consistent quality. As a result, it is not unusual for some paper produced to be scrapped and reprocessed or sold cheaply as job lot. Either way, these variations in quality are undesirable and costly.

Another related problem is how to control refiner operation to repeatedly obtain certain desired finished fiber product characteristics in different batches run at different times, such as different batches run on different days. This problem is not trivial as it is very desirable for paper producers be able to produce different batches of paper having nearly the same characteristics, such as tear strength, tensile strength, brightness, opacity and the like.

In the past, control systems and methods have been employed that attempt to automatically control refiner operation to solve at least some of these problems. One common control system used in paper mills and fiber processing plants throughout the world is a Distributed Control System (DCS). A DCS communicates with each refiner in the mill or fiber processing plant and often communicates with other fiber product processing equipment. A DCS monitors operation of each refiner in a particular fiber product processing plant by monitoring refiner parameters that typically include the main motor power, the dilution water flow rate, the hydraulic load, the feed screw speed, the refiner case pressure, the inlet pressure, and the refiner gap. In addition to monitoring refiner operation, the DCS also automatically controls refiner operation by attempting to hold the load of the motor of each refiner at a particular setpoint. In fact, many refiners have their own motor load setpoint. When the motor load of a particular refiner rises above its setpoint, the DCS adds more dilution water to the refiner to decrease friction. When the motor load decreases below the setpoint, dilution water is reduced or stopped.

During refiner operation, pulp quality and the load on the refiner motor vary, sometimes quite dramatically, over time. Although the aforementioned DCS control method attempts to account for these variations and prevent the aforementioned problems from occurring, its control method assumes that the mass flow of fibrous matter in the stock entering the refiner is constant because the speed of the feed screw supplying the stock is constant. Unfortunately, as a result, there are times when controlling the dilution water flow rate does not decrease or increase motor load in the desired manner. This disparity leads to changes in refining intensity and pulp quality because the specific energy inputted into refining the fibrous matter is not constant. These changes are undesirable because they ultimately lead to the aforementioned problems, as well as other problems.

Hence, while some refiner process control methods have proven beneficial in the past, they in no way have resulted in the type of control over finished fiber product parameters and the repeatability of these parameters that is desired. Thus, additional improvements in refiner process control are needed.

SUMMARY OF THE INVENTION

A system for and method of monitoring and controlling operation of a disc refiner. The method regulates operation of a refiner in response to a refiner process variable preferably in relation to a setpoint. In one preferred implementation, the process variable is based on a temperature. In another implementation, the process variable is based on a pressure. In still another preferred implementation, the process variable is based on a stock consistency. In a further preferred implementation, operation of the refiner can be regulated in response to a refiner energy parameter or a parameter related thereto.

In one implementation, the volumetric flow rate of stock entering the refiner is regulated. In another implementation, the flow rate of dilution water entering the refiner is regulated. In still another implementation, both the stock volumetric flow rate and the dilution water flow rate are regulated.

In one preferred implementation, the volumetric flow rate of stock is regulated in response to a measured or calculated refiner temperature. In another preferred implementation, the dilution water to the refiner is regulated based on the refiner temperature.

In one preferred implementation, the volumetric flow rate of stock is regulated in response to a measured or calculated refiner pressure. In another preferred implementation, the dilution water to the refiner is regulated based on the refiner pressure.

In another preferred implementation, the dilution water to the refiner is regulated based on stock consistency. In still another preferred method, the volumetric flow rate of the stock is regulated based on stock consistency.

If desired, two or more of these parameters can be regulated based on the same process variable. For example, regulation of volumetric flow rate and dilution water can both be based on refiner temperature. Regulation of volumetric flow rate and dilution water can also both be based on refiner pressure. If desired, regulation of volumetric flow rate and dilution water can also both be based on stock consistency.

The refiner temperature is a temperature of stock inside the refiner or adjacent its inlet or outlet. In one preferred implementation, the refiner temperature is a temperature of stock in the refining zone. Where there is more than one sensor in the refining zone, the temperature can be provided by a particular selected sensor or calculated based on the sensor data from more than one sensor. In one preferred embodiment, temperature measurements from multiple sensors are averaged.

The refiner pressure preferably is a pressure of stock inside the refiner, such as a pressure in the refining zone, or a pressure inside the refiner adjacent the refiner inlet or outlet. Where there is more than one sensor in the refining zone, the pressure can be provided by a particular selected sensor or calculated based on the sensor data from more than one sensor. In one preferred embodiment, pressure measurements from multiple sensors are averaged.

Stock consistency can be determined using a consistency sensor upstream or downstream of the refiner. Where a consistency sensor is used, the sensor is located upstream of the refiner, preferably adjacent the refiner inlet.

Stock consistency can also be determined using a novel method that is based on a temperature or a pressure (or both) inside the refiner, preferably inside the refining zone. In one preferred implementation, the method uses temperature or pressure measured inside the refining zone along with other refiner parameters in determining the consistency of stock in the refining zone as a function of time and location in the refining zone. This method advantageously permits consistency of stock to be determined in real time in the refining zone.

A refiner energy related parameter includes refiner energy or power measured in real time. Other refiner energy related parameters include motor load, refiner gap, refiner plate force, hydraulic energy input, or another refiner energy related parameter.

Where volumetric stock flow is regulated, it preferably is regulated by controlling the speed of a feed screw that provides the refiner with stock. Where dilution water flow is regulated, it preferably is regulated by controlling operation of the dilution pump. Other refiner parameters can be controlling using the method of this invention.

So that the process can be controlled despite changes in refiner operation not due to regulation using the method, one preferred implementation pauses to permit refiner operation to stabilize before resuming regulation of refiner operation. For example, where an operator manually changes refiner operation, regulation is paused preferably until refiner operation stabilizes. The same is true where a refiner is also subject to control of a processing device, such as a Distributed Control System (DCS).

In one preferred embodiment, the method is implemented in the form of a controller that preferably is a PI or a PID controller. If desired, a proportional controller can be used. The controller can be a digital or analog controller and can be configured to operate with a digital processor such as a personal computer, a DCS, a programmable controller or the like.

The system includes a processor that receives data related to refiner operation. Suitable data includes data related to the process variable or variables used in regulating refiner operation. In one preferred embodiment, the processor receives data related to one or more of the following parameters: the power inputted into the refiner, the feed screw speed (or volumetric stock flow or feed rate), the temperature of the stock before it enters the refiner, the temperature of stock after it leaves the refiner, a refiner temperature, a refiner pressure, the force exerted on the refiner disks urging them together, the dilution motor power of the dilution pump, the chip washing water temperature, the dilution water temperature, the gap between the refiner disks, as well as other parameters.

In carrying out the method, the processor outputs at least one control signal. Each control signal can be directly provided to the refiner or a component related to the refiner, such as the feed screw or dilution water pump. If desired, each control signal can be provided to another processor, such as a DCS, that causes the DCS to regulate the desired parameter. For example, a control signal can be provided to the DCS that causes the DCS to change feed screw speed. Another control signal can be provided to the DCS that causes the dilution water flow rate to change.

One preferred embodiment of the system uses one or more sensors in the refining zone to provide sensor data from which a process variable calculation or measurement can be made. In one preferred embodiment, the one or more sensors are temperature sensors but can be pressure sensors or a combination of temperature and pressure sensors.

In one preferred embodiment, each sensor is carried by a refiner disk or segment of the disk. In one preferred sensor disk or sensor disk segment, each sensor is imbedded in the refining surface of the disk or segment.

In a preferred sensor embodiment, the sensor has a sensing element carried by a spacer that spaces the sensing element from the material of the disk or segment in which it is imbedded. One preferred spacer is made from an insulating material that preferably thermally insulates the sensing element from the thermal mass of the refiner disk material.

Other objects, features, and advantages of the present invention include: a monitoring and control system and method that is simple, flexible, reliable, and robust, and which is of economical manufacture and is easy to assemble, install, and use.

Other objects, features, and advantages of the present invention will become apparent to those skilled in the art from the detailed description and the accompanying drawings. It should be understood, however, that the detailed description and accompanying drawings, while indicating at least one preferred embodiment of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout and in which.

DETAILED DESCRIPTION OF THE PREFERRED EMBODIMENTS

Figure 1:
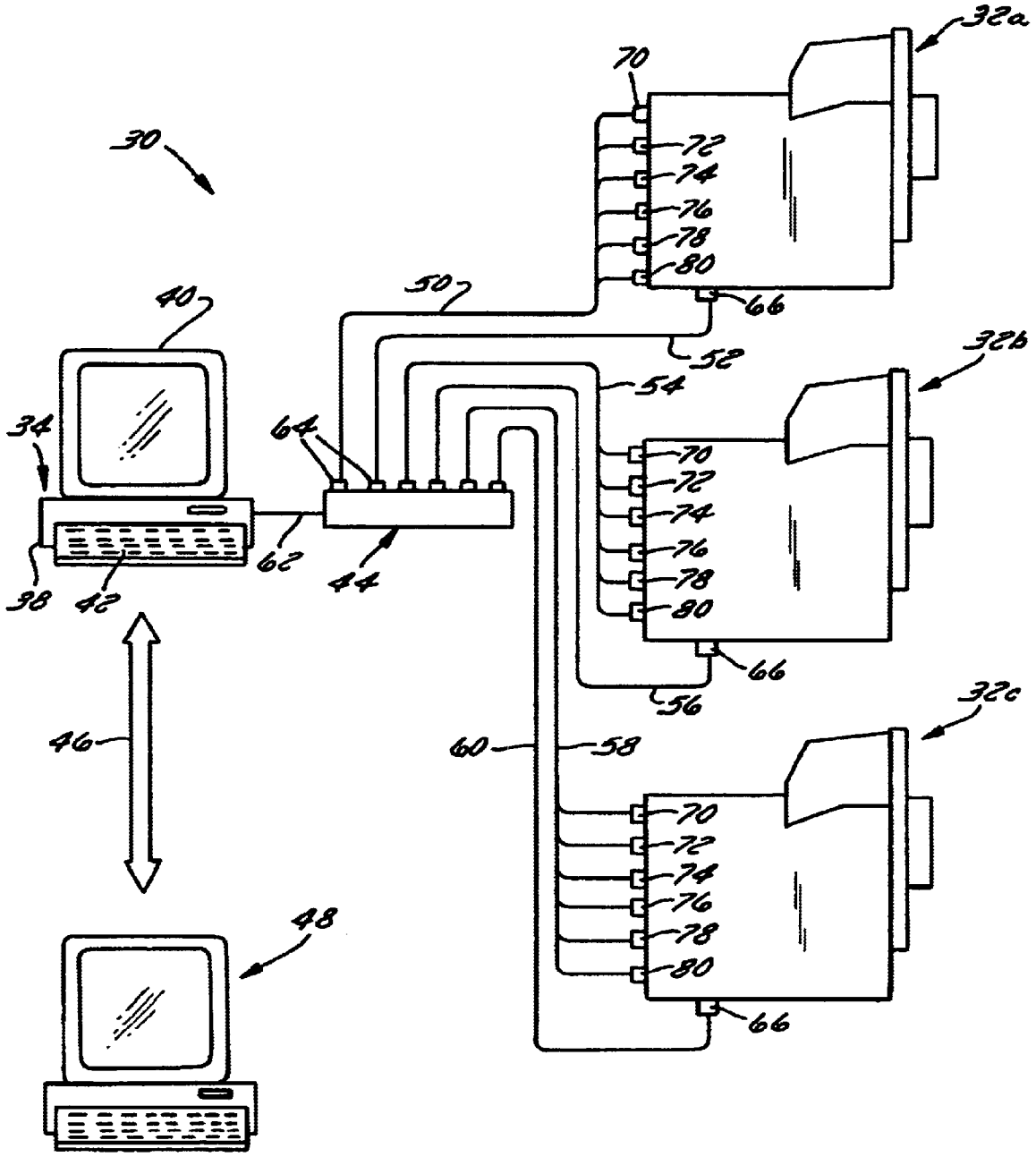
FIG. 1 is a schematic view of a first embodiment of a refiner monitoring and control system.

FIG. 1 schematically illustrates a system 30 for controlling operation of one or more disc refiners 32*a*, 32*b*, or 32*c*. The system includes a control processor 34 that regulates the mass flow of stock entering the refiner in response to one or more monitored or calculated parameters, at least one of which preferably is related to conditions inside a refining zone of the refiner. In one preferred embodiment, the control processor 34 controls operation of a feed screw 66 that supplies the refiner with stock. In another preferred embodiment, the control processor 34 controls the flow rate of dilution water to the refiner. The mass flow is regulated to help keep a process variable at or desirably close to a setpoint that can change during operation. When some aspect of refiner operation is changed, the control processor 34 stops regulating mass flow for a period of time to allow the change to take effect and cause a new setpoint to be reached. The control processor 34 then resumes regulating mass flow using the new setpoint.

In a preferred embodiment of the system 30, the processor 34 comprises a computer 38 that can include a display 40, and one or more input/output devices 42, such as a keyboard and/or a mouse. Such a computer 38 can be a personal computer, a mainframe computer, a programmable controller, or another type of processing device.

If desired, the computer 38 can have on-board memory and can have an on-board storage device.

In the preferred embodiment shown in FIG. 1, the processor 34 preferably also has or includes an input/output device 44 that comprises at least one data acquisition device or a data acquisition system capable of receiving data from one or more of the refiners 32*a*, 32*b*, and 32*c*. For example, in the embodiment of FIG. 1, at least three refiners 32*a*, 32*b*, and 32*c* are linked to the processor 34. This device 44 can be a separate component linking the processor 34 and the refiners 32*a*, 32*b*, and 32*c* in the manner depicted in FIG. 1, or can be an integral part of the processor 34.

The processor 34 and input/output device 44 can be housed in a cabinet 82 (FIG. 3) that can be located in a fiber processing plant, such as a paper mill or the like. The display 40 can be remotely located, such as in a control room of the fiber processing plant. If desired, the processor 34 can be a Distributed Control System (DCS) at the fiber processing plant or can be a component of the DCS.

The processor 34 can communicate via a link 46 with an off-site computer 48 that is used for troubleshooting and downloading updates or changes to the method of refiner control carried out by the processor 34. Such a link 46 can be a wireless link or a wire link between computers 38 and 48. Examples of suitable links 46 include a link via the Internet, such as an FTP or TCP/IP link, or a direct telephone link.

The processor 34 is directly or indirectly connected by links, indicated by reference numerals 50–60 in FIG. 1, to each one of the refiners 32*a*, 32*b* and 32*c*. For example, one or more of the links 50–60 can comprise a cable or a wireless communication link or the like.

The processor 34 is shown in FIG. 1 as being connected by a link 62 to the input/output device 44. In one preferred embodiment, the device 44 is a data acquisition and control system that includes ports or modules 64. Where data acquisition is needed, each port or module can comprise a data acquisition card. If desired, the device 44 can be comprised of one or more data acquisition cards installed in slots inside computer 38. While FIG. 1 depicts a link from each one of the refiners 32*a*, 32*b*, and 32*c* running to a single card or module, a dedicated card or module can accept two or more such links.

Each refiner 32*a*, 32*b*, and 32*c* has a plurality of sensors that provide data to the processor 34. For example, data from at least one sensor 70 relating to temperature, pressure or a combination of temperature and pressure can be communicated via link 50 to processor 34. Data from other sensors 72–80 can also be directly or indirectly utilized. For example, sensors 72–80 can provide data relating to one or more of the following parameters: refiner main motor power, refiner plate force, the refiner gap, the rate of flow of dilution water added during refining, conveyor screw rotation, the flow rate of fibrous matter being introduced into the refiner, as well as consistency. Where the processor 34 is a DCS, all of this sensor data is obtained during refiner operation.

Where refiner main motor power is monitored, an example of a suitable sensor is one that senses the voltage or current from a current transformer coupled to the refiner motor. Where main motor power is monitored, an example of a suitable sensor is one that senses the voltage or current from a current transformer coupled to the refiner motor. Where refiner plate force is monitored, examples of suitable sensors include one or more of the following: an accelerometer, a strain gauge, or a pressure sensor that senses the pressure or force urging the refiner plates toward each other. Where refiner gap is monitored, examples of sensors include one or more of the following: an inductive sensor carried by at least one of the refiner plates or a Hall effect sensor. Where rate of flow of dilution water is monitored, a flow meter can be used. Where conveyor screw rotation is monitored, a sensor on the conveyor screw motor can be used to provide, for example, the rate of screw rotation. A flow meter is an example of a sensor that can be used to provide data from which a flow rate of fibrous matter into the refiner can be obtained. Where a flow meter is used, examples of suitable flow meters that can be used include paddle-wheel type sensors, optical sensors, viscosity meters, or other types of flow meters. Sensor data from one or more sensors, including the aforementioned sensors, can be used in making a consistency measurement that can be used as a setpoint by the processor 34.

A number of these refiner-related sensors and other sensors that can be monitored by the system 30 of this invention are disclosed in more detail in one or more of U.S. Pat. Nos. 4,148,439; 4,184,204; 4,626,318; 4,661,911; 4,820,980; 5,011,090; 5,016,824; 5,491,340; and 5,605,290, the disclosures of each of which are expressly incorporated herein by reference.

Figure 2:
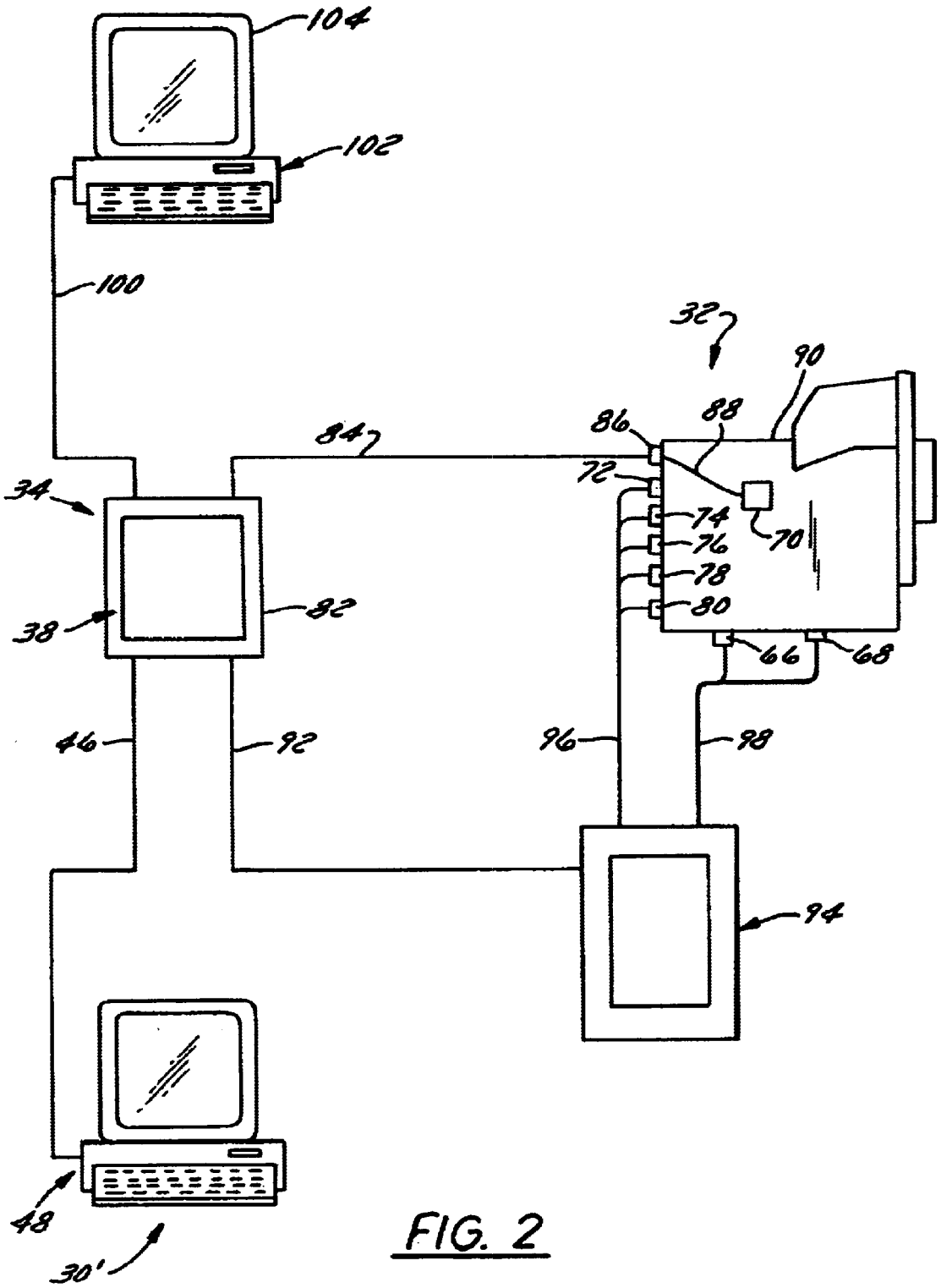
FIG. 2 is a schematic view of a second embodiment of a refiner monitoring and control system.

FIG. 2 schematically illustrates another preferred embodiment of system 30'. The control processor 34 is a computer 38 that is located in a cabinet 82 that is located on site. There is a link 84 from the processor 34 to a signal conditioner 86 carried by the refiner 32. The signal conditioner 86 is attached by another link 88 to each sensor 70.

The signal conditioner 86 connects with each sensor 70 and converts the sensor output to an electrical signal that is transmitted to the processor 34. For example, one preferred signal conditioner 86 typically outputs a current (for each sensor) in the range of between four and twenty milliamperes. The magnitude of the signal depends upon the input to the sensor (and other factors including the type of sensor or sensors) and provides the processor the information from which it can determine a sensor measurement. If desired, more than one signal conditioner can be mounted to the casing or housing of the refiner 32. As is depicted in FIG. 2, the signal from each sensor 70 can first be communicated by a link 84 to a DCS 94 before being communicated to processor 34. In some instances, a signal conditioner 86 may not be needed.

The processor 34 is connected by a communications link 100, such as a phone line, to a device 102 located in a control room that preferably is located in the fiber processing plant. The device 102 can be a computer and includes a display 104 upon which graphical information is shown that relates to refiner operation and control.

The processor 34 is depicted in FIG. 2 as being connected by another communications link 92 to a DCS 94 that preferably is located on site. The DCS 94 is connected by a second link 96 to one or more of refiner sensors 72, 74, 76, 78, and 80 that provide the DCS 94 with information about a number of parameters that relate to refiner operation. A third link 98 connects the DCS 94 to each feed screw motor (or feed screw motor controller) 66 and each dilution water motor (or feed screw motor controller) 68, only one of which is schematically depicted in FIG. 2. The link 98 can include a separate link to each feed screw motor (or motor controller) 66 and each dilution water motor (or motor controller) 68 for that particular refiner 32. At least one of the purposes of link 98 is to convey control signals from the DCS 94 to each feed screw motor (or motor controller) 66 and each dilution water motor (or motor controller) 68 to control their operation. Another purpose of link 98 can be to provide feedback about motor speed so that the mass flow rate of the feed screw and flow rate of dilution water can be determined.

The link 92 provides the processor 34 with information from the DCS 94 that preferably includes the main motor power of the refiner 32, the force exerted on the refiner disks urging them together (or hydraulic pressure or force), the dilution motor power of the refiner for each dilution pump, DCS ready status, several other DCS signals, the refiner case pressure, the refiner inlet pressure, the chip washing water temperature, the dilution water temperature, as well as the gap between refiner disks. The link 92 also enables the processor 34 to communicate with the DCS 94 to cause the DCS 94 to change the mass flow rate of stock entering the refiner 32. The link 92 can also be used by the processor 34 to communicate with the DCS 94 to change the rate of flow of dilution water entering the refiner 32. The link 92 preferably comprises a bidirectional communications link. Communication preferably is in the form of a digital or analog control signal sent by the processor 34 to the DCS 94.

Figure 3:
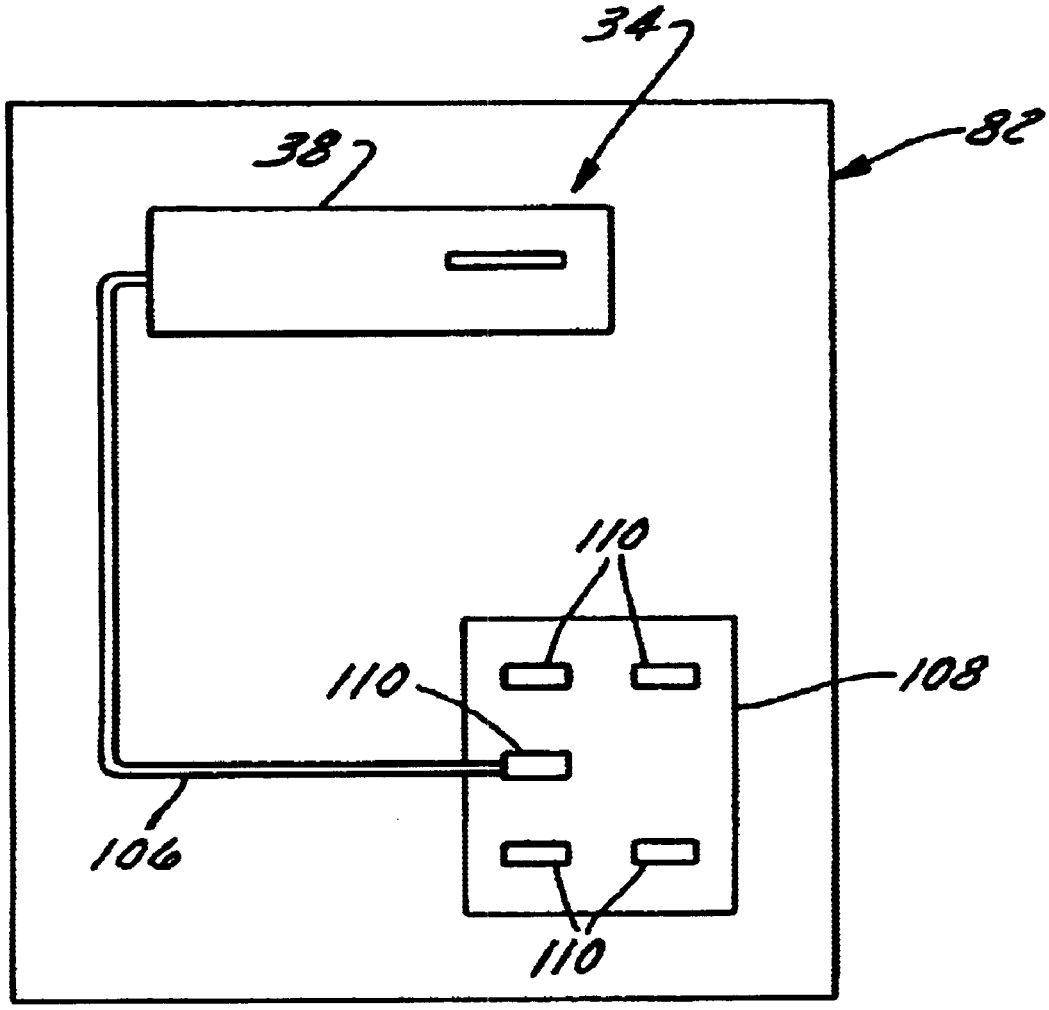
FIG. 3 is front plan view of a cabinet housing a control computer of the refiner monitoring and control system.

FIG. 3 depicts the contents of a cabinet 82 that houses the processor 34. In addition to any needed data acquisition modules or data acquisition system (not shown in FIG. 3), the processor 34 can communicate via a link 106 with a connector box 108 that includes a plurality of calibration modules 110. Each calibration module 110 holds calibration data for a particular sensor or a particular set of sensors 70. Each calibration module 110 has on board storage or memory, such as an EPROM, EEPROM, or the like, that holds sensor calibration data. When data is read from a particular sensor or a particular set of sensors 70, the calibration data that relates to that particular sensor or that particular group of sensors 70 is applied to make the resultant sensor measurement more accurate.

The refiner 32 can be a refiner of the type used in thermomechanical pulping, refiner-mechanical pulping, chemithermomechanical pulping, or another type of pulping or fiber processing application where a rotary disk refiner is used. The refiner 32 can be a counterrotating refiner, a double disc or twin refiner, or a conical disc refiner known in the industry as a CD refiner.

Figure 4:
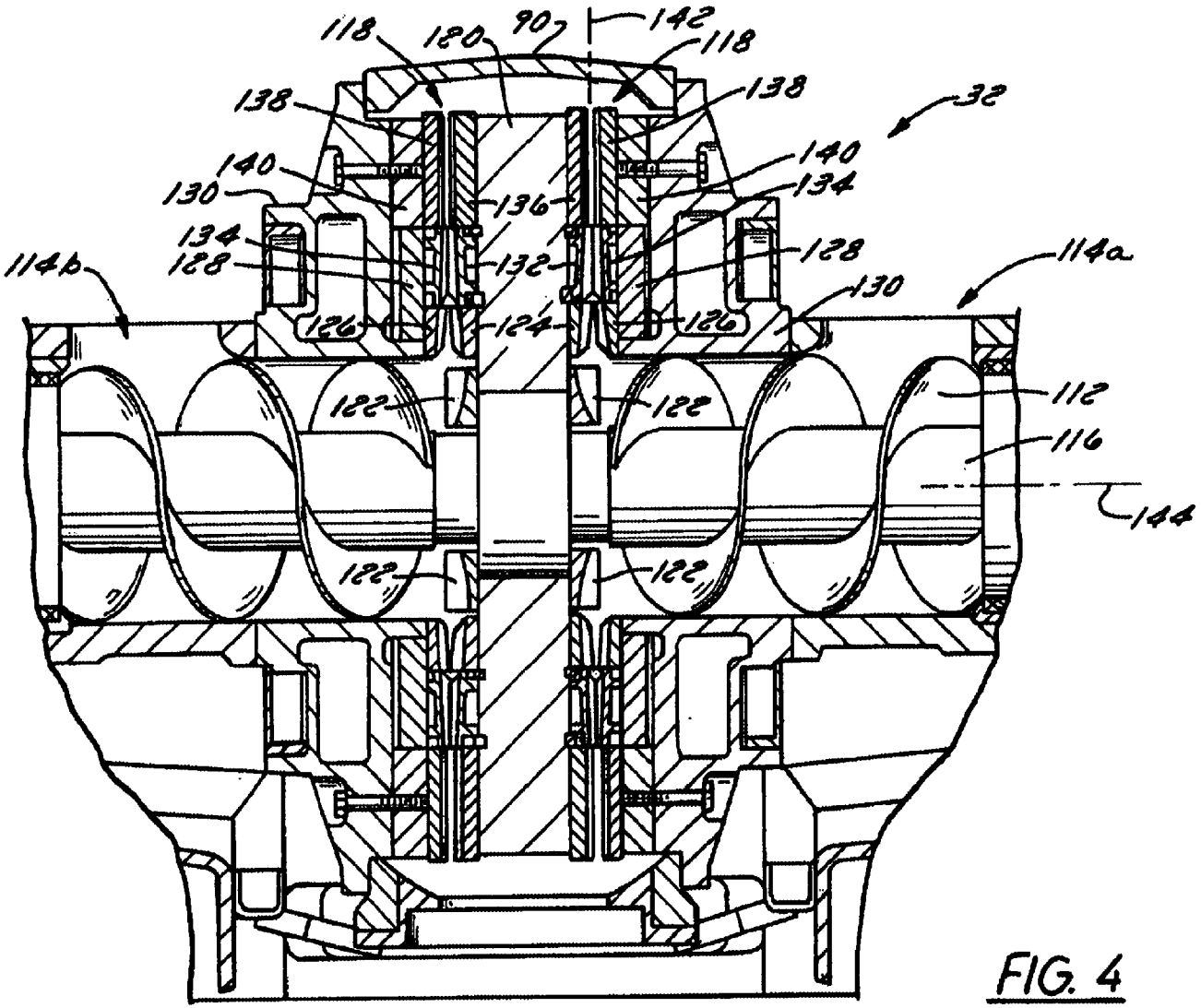
FIG. 4 is a fragmentary cross sectional view of an exemplary twin refiner.

An example of a refiner 32 that is a double disc or twin refiner is shown in FIG. 4. The refiner 32 has a housing or casing 90 and an auger 112 mounted therein which urges a stock slurry of liquid and fiber introduced through stock inlets 114*a* and 114*b* into the refiner 32. The auger 112 is carried by a shaft 116 that rotates during refiner operation to help supply stock to an arrangement of treating structure 118 within the housing 90. An annular flinger nut 122 is generally in line with the auger 112 and directs the stock radially outwardly to a plurality of opposed sets of breaker bar segments 124 and 126.

Each set of breaker bar segments 124 and 126 preferably is in the form of sectors of an annulus, which together form an encircling section of breaker bars. One set of breaker bar segments 124 is carried by a rotor 120. The other set of breaker bar segments 126 is carried by another portion of the refiner 32, such as a stationary mounting surface 128, e.g., a stator, of the refiner or another rotor (not shown). The stationary mounting surface 128 can comprise a stationary part 130 of the refiner frame, such as the plate shown in FIG. 4.

Stock flows radially outwardly from the breaker bar segments 124 and 126 to a radially outwardly positioned set of opposed refiner discs 132 and 134. This set of refiner discs 132 and 134 preferably is removably mounted to a mounting surface. For example, disc 132 is mounted to the rotor 120 and discs 134 are mounted to mounting surface 128.

The refiner 32 preferably includes a second set of refiner discs 136 and 138 positioned radially outwardly of the first set of discs 132 and 134. The refiner discs 136 and 138 preferably are also removably mounted. For example, disc 136 is mounted to the rotor 120 and disc 138 is mounted to a mounting surface 140. Each pair of discs of each set are spaced apart so as to define a small gap between them that typically is between about 0.005 inches (0.127 mm) and about 0.125 inches (3.175 mm). Each disc can be of unitary construction or can be comprised of a plurality of segments.

The first set of refiner discs 132 and 134 is disposed generally parallel to a radially extending plane 142 that typically is generally perpendicular to an axis 144 of rotation of the auger 112. The second set of refiner discs 136 and 138 can also be disposed generally parallel to this same plane 142. This plane 142 passes through the refiner gap and refining zone between each pair of opposed refiner disks. Depending on the configuration and type of refiner, different sets of refiner discs can be disposed in different planes.

During operation, the rotor 120 and refiner discs 132 and 136 rotate about axis 144 causing relative rotation between refiner discs 132 and 136 and refiner discs 134 and 138. Typically, each rotor 120 is rotated at a speed of between about 400 and about 3,000 revolutions per minute. During operation, fiber in the stock slurry is refined as it passes between the discs 132, 134, 136, and 138.

Figure 5:
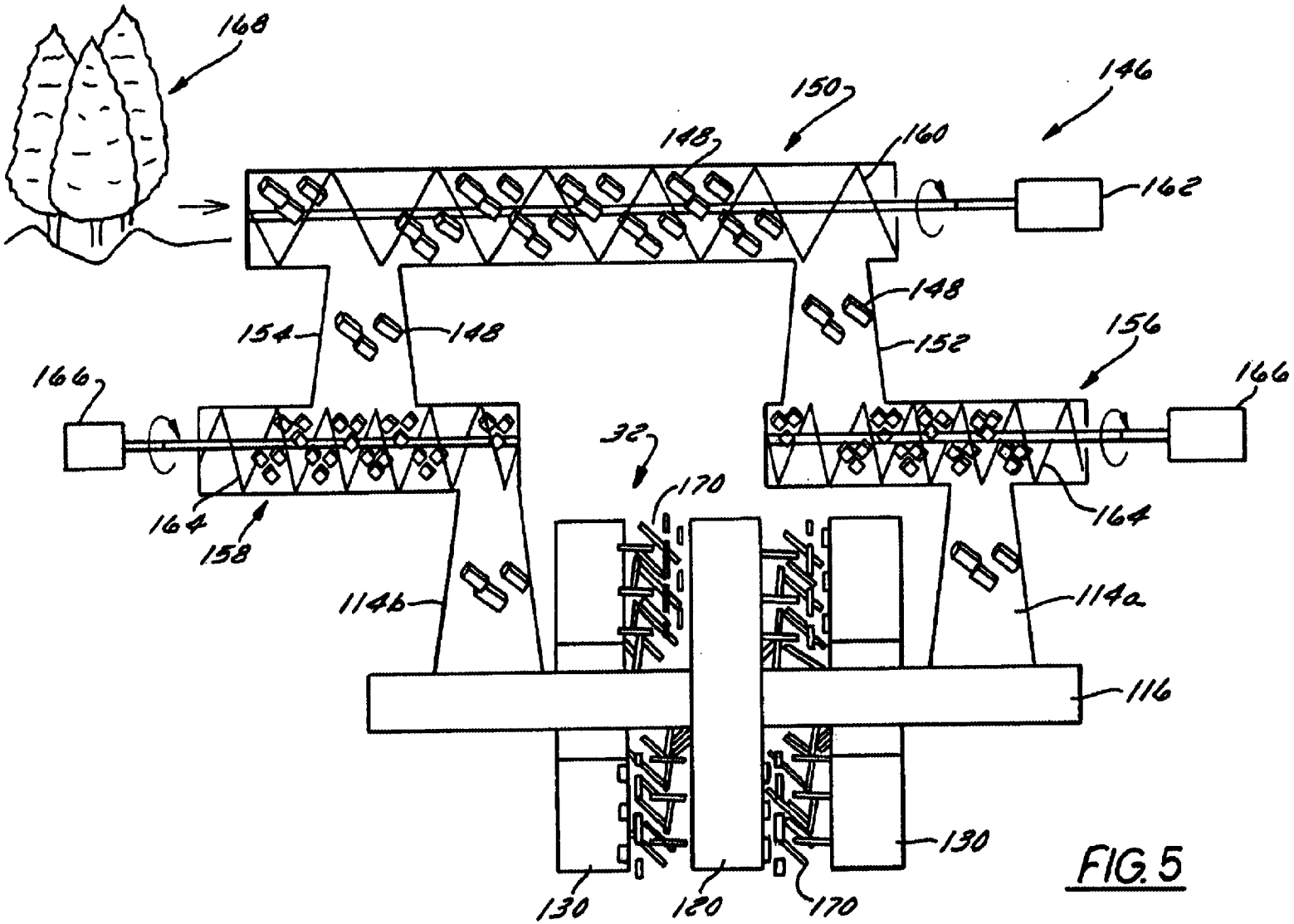
FIG. 5 is a schematic of a system for supplying the refiner with stock.

FIG. 5 schematically depicts the refiner 32 and includes a fiber delivery system 146 for delivering fibrous matter or fiber to be refined 150 to each inlet 114*a* and 114*b* of the refiner 32. The fibrous matter or fiber 148 can be in the form of wood chips, pulp, fabric, or another fiber used in the manufacturing of products made from, at least in part, fiber. The fiber 148 preferably is carried by or entrained in a liquid to form a stock slurry.

In the exemplary preferred embodiment shown in FIG. 5, the fiber 148 is transported along a fiber transport conveyor 150 that urges fiber (preferably in a stock slurry) along its length until it reaches an outlet that can be connected directly or indirectly to a refiner. In the embodiment shown in FIG. 5, the fiber transport conveyor 150 has outlets 152 and 154 that are each connected to a metering conveyor 156 and 158. Each metering conveyor, in turn, is connected to one of the refiner inlets 114*a* and 114*b*. This arrangement advantageously enables mass flow to be separately and more precisely metered to each refiner inlet 114*a* and 114*b* of a double disc refiner or the like. This arrangement can also be used to distribute and meter fiber 148 to two, three, four, or more refiners using a common conveyor 150 and a separate metering conveyor for each refiner.

In one preferred embodiment, the fiber transport conveyor 150 includes an auger or screw 160 driven by a motor 162 that can be, for example, an electric motor or a hydraulic motor. The motor 162 can be controlled by the DCS 94 or directly controlled by control processor 34, if desired, in regulating mass flow. Where a metering conveyor is used, each metering conveyor 156 and 158 preferably includes an auger or screw 164 driven by a motor 166. Each motor 166 of each metering conveyor 156 and 158 is controlled by the DCS 94 or by processor 34.

As is shown in FIG. 5, trees (such as logs) 168 typically are processed into chips 148 that are transported by conveyor 150 to an outlet 152 or 154. Chips 148 pass from one of the outlets to one of the metering conveyors 156 or 158. The metering rate of each metering conveyor 156 and 158 is controlled by processor 34 to regulate the mass flow rate of stock entering each refiner inlet 114*a* and 114*b*. After being refined by the refiner 32, the refined fiber 170 can be transported to another refiner for further refining, a screen or other filter, or to the fiber processing machine, such as a paper machine, that processes the refined fiber 140 into a product.

Figure 6:
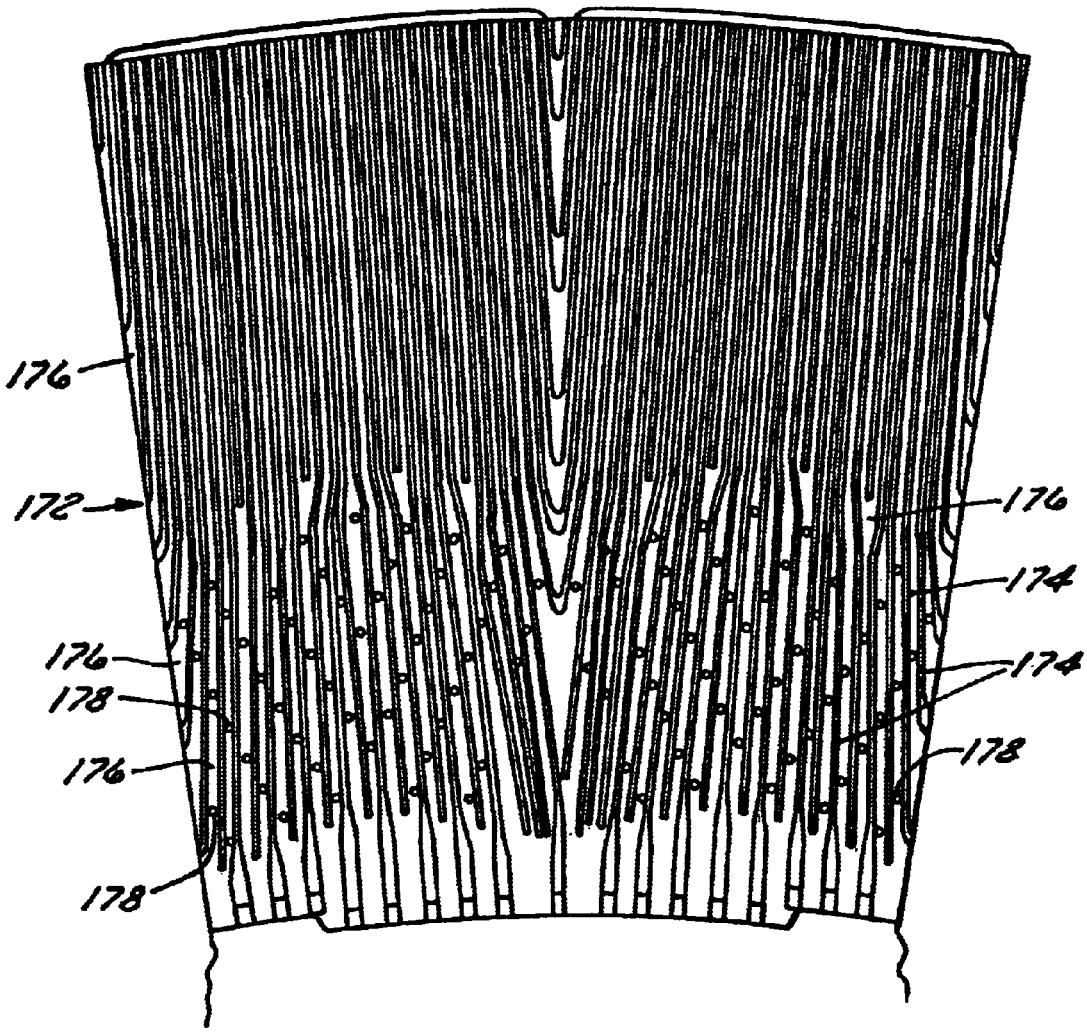
FIG. 6 is a front plan view of an exemplary refiner disk segment.

FIG. 6 depicts an exemplary segment 172 of a refiner disk that preferably is removable so it can be replaced, such as when it becomes worn. The segment 172 has a plurality of pairs of spaced apart upraised bars 174 that define grooves or channels 176 therebetween. The pattern of bars 174 and grooves 176 is an exemplary pattern as any pattern of bars 174 and grooves 176 can be used. If desired, surface or subsurface dams 178 can be disposed in one or more of the grooves 176.

During refining, fiber in the stock that is introduced between opposed refiner disks is refined by being ground, abraded, or mashed between opposed bars 174 of the disks. Stock disposed in the grooves 176 and elsewhere between the disks flows radially outwardly and can be urged in an axial direction by dams 178 to further encourage refining of the fiber. Depending on the construction, arrangement and pattern of bars 174 and grooves 176, differences in angle between the bars 174 of opposed disks due to relative movement between the disks can repeatedly occur. Where and when such differences in angle occur, radial outward flow of stock between the opposed disks is accelerated or pumped. Where and when the bars 174 and grooves 176 of the opposed disks are generally aligned, flow is retarded or held back.

Figure 7:
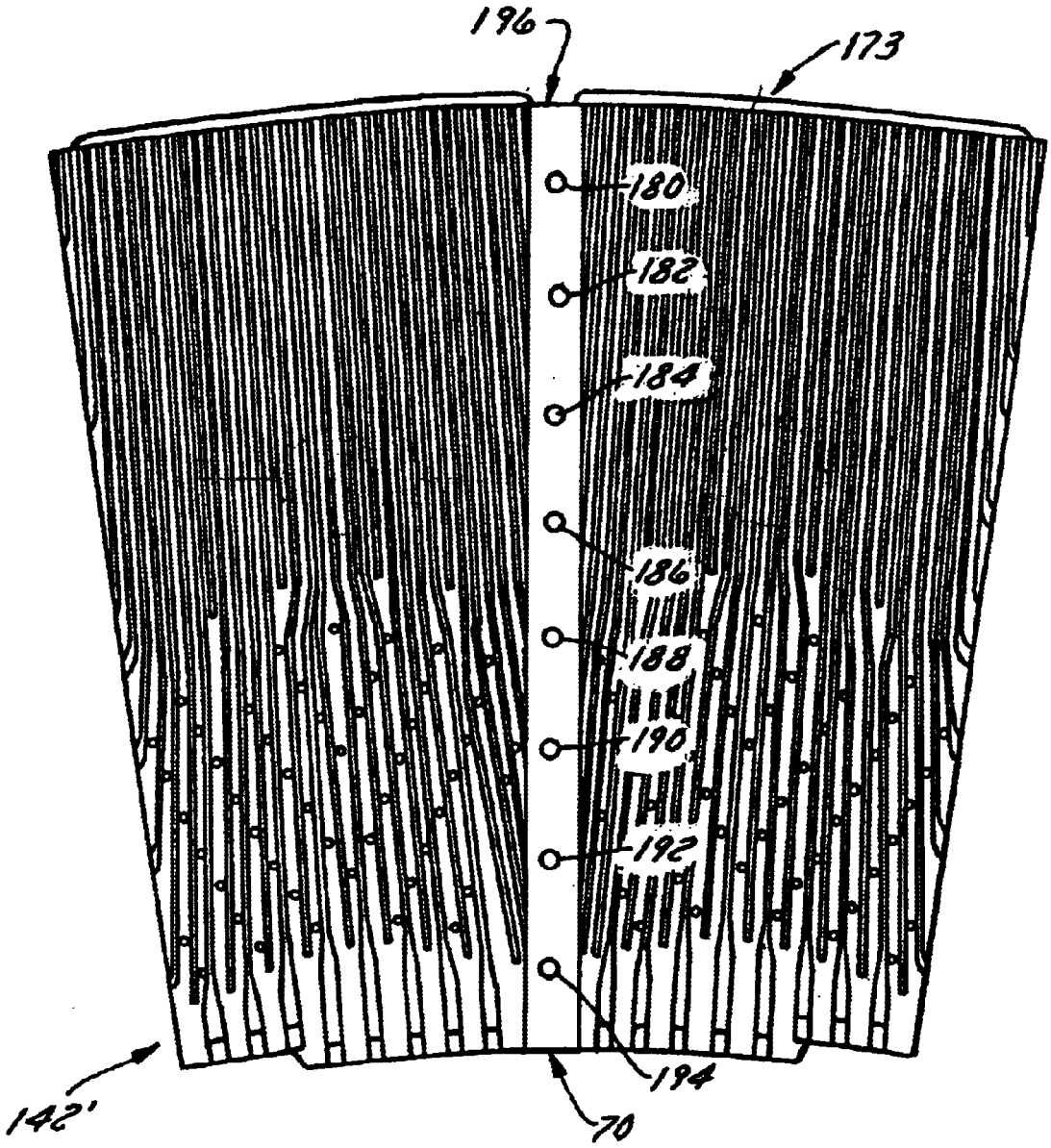
FIG. 7 is a front plan view of a refiner disk segment that has a plate with sensors used to sense a parameter, such as a process variable, in the refining zone.

Referring to FIG. 7, a portion of one refiner disk or a refiner disk segment 173 of refiner 32 contains a sensor device 70. The sensor device 70 includes at least one sensor capable of sensing at least one parameter in a refining zone during refiner operation. The sensed parameter can be used as the setpoint or can be used in its determination. In the embodiment shown in FIG. 7, the sensor device 70 is comprised of a sensor assembly 196 that has a plurality of spaced apart sensors 180, 182, 184, 186, 188, 190 192, and 194. If desired, the sensor assembly 196 can have at least three sensors, at least four sensors, at least five sensors and can have more than eight sensors. Preferably, at least one refiner disk of each refiner 32 being monitored by processor 34 is equipped with a sensor device 70 and, where segmented, is equipped with at least one sensor segment 173.

In the sensor disk segment embodiment shown in FIG. 7, the sensors 180, 182, 184, 186, 188, 190, 192, and 194 are carried by a bar 198 received in a radial channel or pocket in the face of the segment. The bar 198 can be, for example, frictionally retained, affixed by an adhesive, welded, or retained in the disk or disk segment using fasteners. Each sensor 180, 182, 184, 186, 188, 190, 192, and 194 has at least one wire (not shown) to enable a signal to be communicated to signal conditioner and/or a data acquisition device. Where the segment 173 is carried by a rotor 120, a slip ring (not shown) can be connected to the wires connected to the sensors 180, 182, 184, 186, 188, 190, 192, and 194. Telemetry can also be used.

Figure 8:
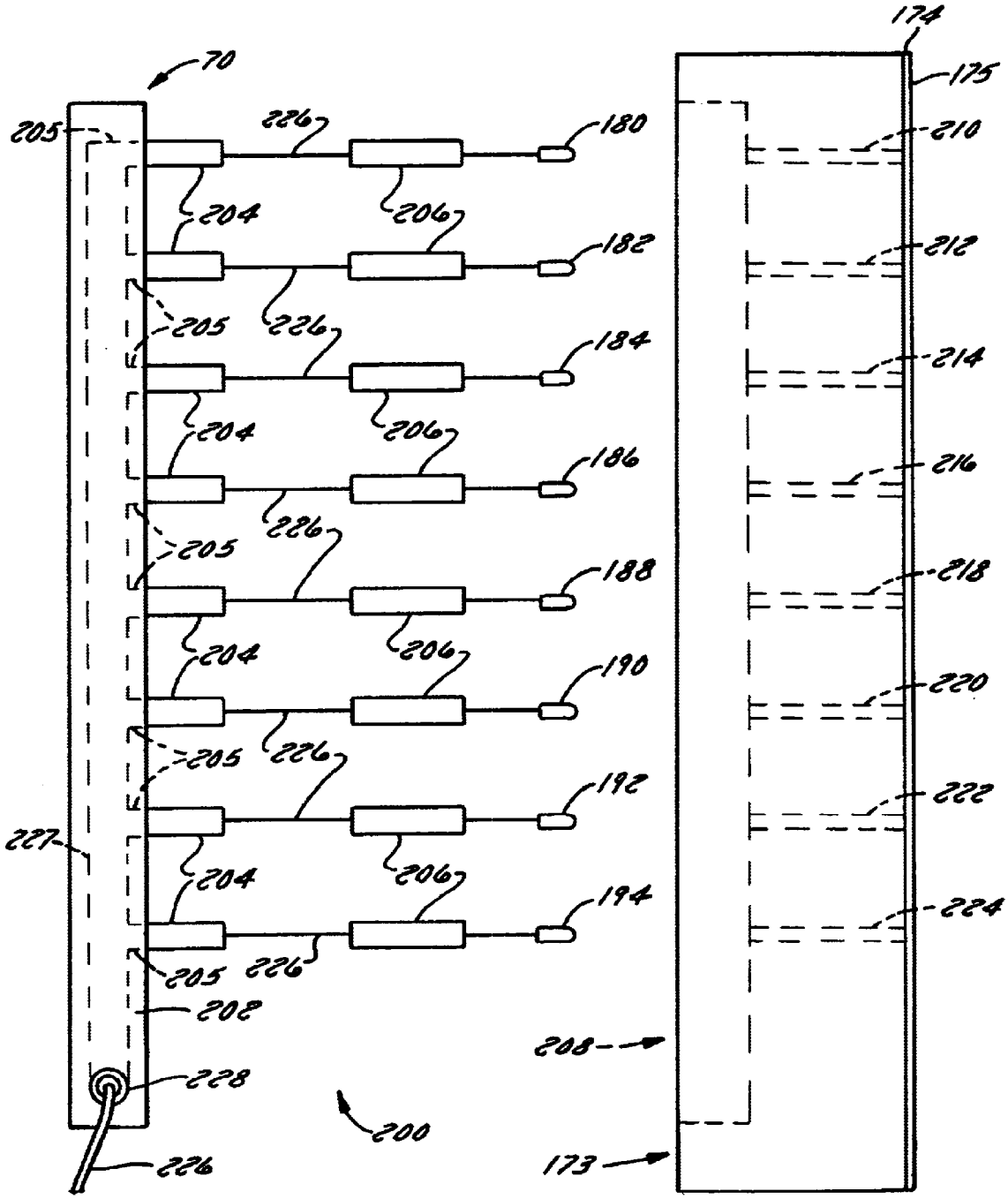
FIG. 8 is an exploded side view of a second refiner disk with sensors embedded in the refining surface of the disk.

In another preferred embodiment, FIG. 8 illustrates a different sensing assembly 200 that includes a manifold-like fixture 202 that can have a plurality of outwardly extending and tubular sensor holders 204. In a preferred embodiment, there are no sensor holders as at least part of each sensor 180, 182, 184, 186, 188, 190, 192, and 194 is received in a bore 205 (shown in FIG. 8 in phantom) in the fixture 202. The fixture 202 is disposed in a pocket 208 (shown in phantom in FIG. 8) in the rear of the sensor refiner disk segment 173.

When the disk segment 173 is assembled each sensor 180, 182, 184, 186, 188, 190, 192, and 194 is received in its own separate bore 210, 212, 214, 216, 218, 220, 222, and 224 such that an axial end of each sensor is exposed to the refining zone during refiner operation. Each sensor 180, 182, 184, 186, 188, 190, 192, and 194 is at least partially received in a spacer 206 that spaces the sensor from the surrounding refiner disk material. At least where the sensor is a temperature sensor, the spacer 206 is an insulator that thermally insulates the sensor from the thermal mass of the refiner disk segment 173. A preferred insulating spacer 206 is made of ceramic, such as alumina or mullite.

When assembled to the segment 173, an axial end of each sensor 180, 182, 184, 186, 188, 190, 192, and 194 is disposed no higher than the axial surface 175 of the bars 174 of the disk segment 173. Preferably, the axial end of each sensor 180, 182, 184, 186, 188, 190, 192, and 194 is disposed at least about fifty thousandths of an inch below the axial surface 175 of the portion of the bar 174 adjacent the sensor. In one preferred embodiment, each sensor 180, 182, 184, 186, 188, 190, 192, and 194 is disposed at least one-hundred thousandths of an inch below the axial surface of the portion of the bar 174 adjacent the sensor.

When assembled, each sensor is telescopically received in one of the spacers 206, and the spacer 206 is at least partially telescopically received in one of the bores 205 in the fixture 202. Each sensor has at least one wire 226 that passes through one of the insulating tubes 206, one of the sensor holders 204, and through a hollow in the bar 202 until it reaches outlet 228 located adjacent one end of the bar 202. Although not shown, a sealant, such as silicone or a high temperature refiner plate potting compound, can be disposed in a hollow 227 in the fixture 202 to protect the wires 226 and prevent steam and stock from leaking from the refining zone. In another preferred embodiment, the fixture 202 is eliminated and replaced by a high temperature potting compound that seals and holds the wires 226 in place. Where a fixture 202 is used, it preferably is anchored to the segment 173 by an epoxy or potting compound.

In one preferred embodiment, at least one of the sensors 180, 182, 184, 186, 188, 190, 192, and 194 is a temperature sensor, such as an RTD, a thermocouple, or a thermistor. Where measurement of absolute temperature in the refining zone is desired, a preferred temperature sensor is a platinum RTD that has three wires.

Where only the relative difference in temperature is needed, other kinds of temperatures sensors can also be used. Suitable examples include platinum RTD temperature sensors; nickel, copper, and nickel/iron RTD temperature sensors; and thermocouples, such as J, K, T, E, N, R, and S thermocouples.

In another preferred embodiment, each of the sensors 180, 182, 184, 186, 188, 190, 192, and 194 is a pressure sensor, such as a ruggedized pressure transducer, which can be of piezoresistive or diaphragm construction and that is used to sense pressure in the refining zone. An example of a pressure transducer that can be used is a Kulite XCE-062 series pressure transducer marketed by Kulite Semiconductor Products, Inc. of One Willow Tree Road, Leonia, N.J.

In still another preferred embodiment, the sensing assembly 196 or 200 is comprised of a combination of pressure and temperature sensors. For example, sensing assembly 196 or 200 can be comprised of a single temperature sensor that senses temperature in the refining zone and a single pressure sensor that senses pressure in the refining zone. The sensing assembly 196 or 200 can also be comprised of a plurality of temperature sensors and a plurality of pressures that sense temperature and pressure at different locations in the refining zone.

Figure 9:
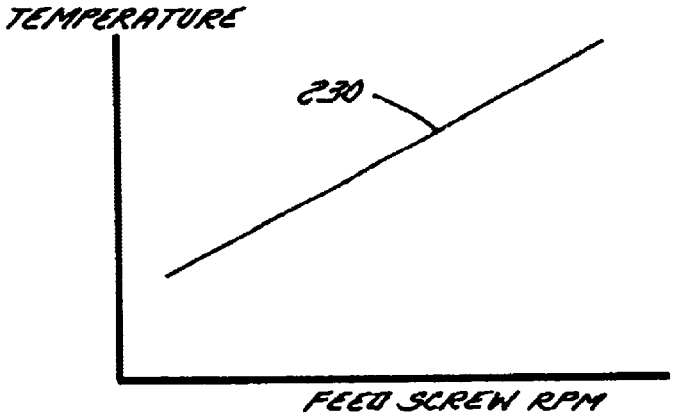
FIG. 9 is a graph showing a generally linear relationship between a process variable, namely refiner temperature, and the controlled variable, namely feed screw speed.
Figure 10:
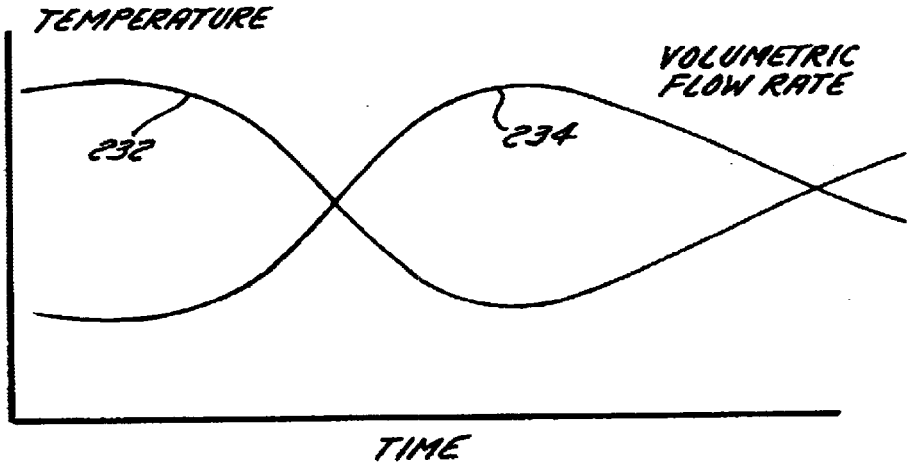
FIG. 10 is a graph depicting controlling the process variable, namely refiner temperature, by regulating the controlled variable, namely volumetric flow rate of stock entering the refiner.
Figure 11:
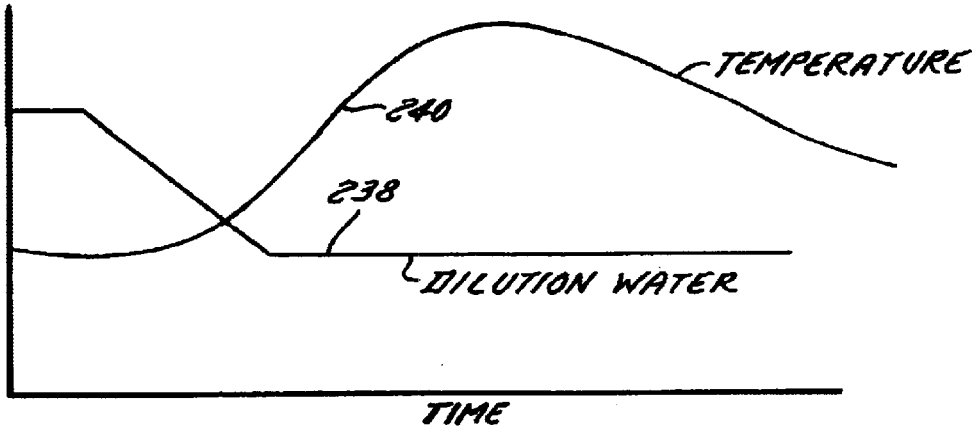
FIG. 11 is a graph illustrating the relationship between a process variable, namely refiner temperature, and a controlled variable, namely dilution water flow rate.

FIGS. 9–11 are directed to a method of controlling refiner operation. It has been long been assumed that a constant feed screw speed results in a constant volumetric flow rate of stock into a refiner and that that a constant stock volumetric flow rate produces a constant mass flow rate of fiber into the refiner. However, it has been discovered that the fiber mass flow rate can vary even when the feed screw speed and volumetric flow rate of stock remain constant. It is believed that these variations in fiber mass flow rate that occur when the feed screw speed is constant are caused by variations in the density of the fiber in the stock, namely changes in wood density, by variations in chip size, by variations in chip moisture content, by feed screw wear over time, by process upsets that occur upstream of the refiner, and by other reasons that are often specific to the mill in which the refiner is installed.

In one preferred control method, refiner operation is affected by controlling the volumetric flow rate of stock entering the refiner in accordance with a process variable that, in one preferred implementation of the control method, is based on, at least in part, at least one parameter that relates to conditions in the refining zone. Refiner process control is achieved by adjusting the volumetric flow rate of stock in response to changes in a process variable relative to its setpoint.

In another preferred control method, refiner operation is affected by controlling the flow rate of dilution water entering the refiner in accordance with a process variable that, in one preferred implementation of the control method, preferably is also based on, at least in part, at least one parameter that relates to conditions in the refining zone. Refiner process control is achieved by adjusting the rate of flow of dilution water in response to changes in a process variable relative to its setpoint.

In another preferred implementation of the control method, refiner operation is regulated in response to a refiner energy parameter or a parameter related thereto that can be used as the process variable. In one preferred implementation, the refiner energy parameter includes refiner energy sensed or determined in some manner and/or refiner power sensed or determined in some manner. Examples of preferred parameters that can also be used as a refiner energy related process variable include motor load, refiner energy, refiner power, refining gap (measured, sensed and/or calculated), refiner plate force, and hydraulic energy input.

By regulating the volumetric flow rate of the stock to keep the fiber mass flow more stable, the fiber bundles in the stock are impacted with a more constant specific energy. This leads to more consistent refining intensity, which greatly reduces variations in motor load and pulp quality. Because variations in motor load are reduced, less energy is used during refining.

When either or both control methods are implemented in a primary refiner, variation in pulp quality measured as freeness, long fiber content, shives, etc. (CSF) can be reduced, the occurrence of shives can be reduced, load swings can be decreased, clashing of refiner disks can lessen, and a more uniform fiber distribution preferably is produced. When implemented in a secondary refiner, refiner load is more stable, the energy required for a given CSF target can be reduced, and the reject rate can be decreased. The result is lower Kraft usage and more consistent pulp quality that produces a fiber product with better and more consistent tear, tensile, burst, and drainage characteristics.

FIG. 9 is a graph with a line 230 that shows a generally linear correlation between a process variable and the volumetric flow rate of stock entering the refiner. In the case of the graph shown in FIG. 9, the process variable is a temperature in the refining zone. The correlation strongly shows that, for all else remaining the same, the temperature in the refining zone substantially linearly increases with increasing volumetric flow rate of the stock resulting from increasing the speed of the feed screw. This correlation also holds true for pressure in the refining zone, as well as for the temperature at the refiner inlet and outlet.

There is also a generally linear correlation between the dilution water flow rate and consistency. As dilution water flow rate is increased, consistency decreases and vice versa.

FIG. 10 is a second graph of a pair of curves that depicts an inverse relationship between a process variable 232 and volumetric flow rate 234. In the case of the graph shown in FIG. 10, the process variable is temperature. FIG. 10 illustrates that when temperature drops, it can be increased by increasing the speed of the feed screw rate to increase the volumetric flow rate of stock entering the refiner. If it is assumed that the consistency of the stock entering the refiner remains constant, increasing the volumetric flow rate will generally increase the temperature (and pressure) in the refining zone. This will also have the affect of increasing the temperature (and pressure) at the refiner inlet and the refiner outlet.

FIG. 11 is a third graph of a pair of curves that shows the relationship between the flow rate of dilution water 238 and a process variable 240 (temperature) that preferably is a refining zone temperature. As dilution water flow rate is reduced, the temperature in the refining zone rises and vice versa. Thus, dilution water flow rate can be controlled to regulate refiner temperature. Dilution water flow rate can be controlled in addition to or in combination with the feed screw speed.

Figure 12:
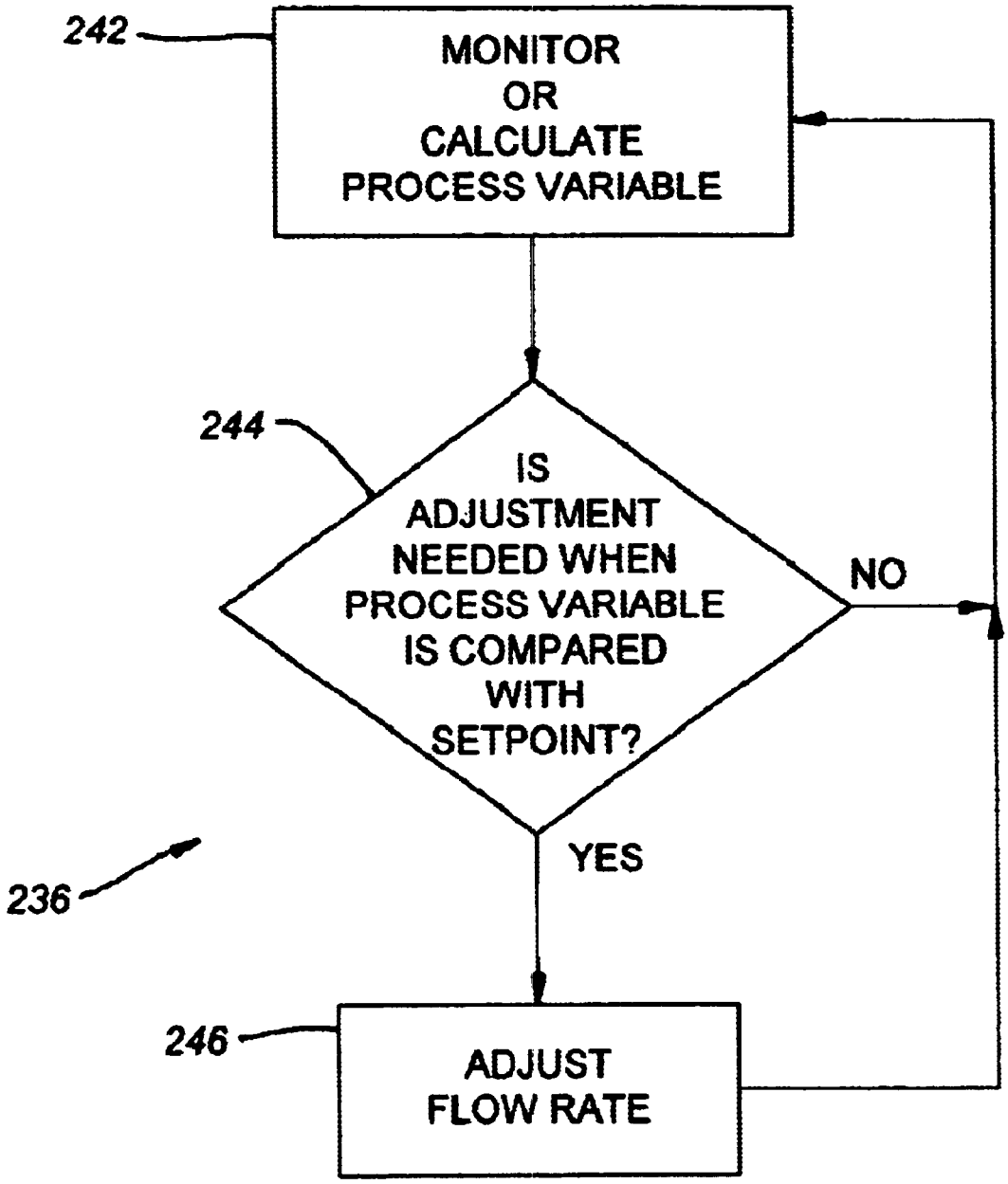
FIG. 12 is a flowchart illustrating a preferred method of controlling refiner operation.

FIG. 12 schematically depicts a preferred embodiment of the refiner control method 236. During operation, processor 34 monitors a number of refiner parameters including main motor power, dilution water flow rate, and refiner disk pressure (hydraulic pressure). At least one of other parameter that is monitored is a parameter that relates to conditions in the refining zone. One preferred parameter is a temperature in the refining zone that can be an absolute temperature. Another preferred parameter is a pressure in the refining zone that can be an absolute pressure. If desired, other parameters can also be monitored including refiner inlet and outlet temperatures and/or pressures. If desired, pressures and temperatures can both be monitored.

In one preferred embodiment, the process variable is a monitored parameter, such as a refining zone temperature and pressure. The process variable can also be a refiner inlet or outlet temperature or pressure. In another preferred embodiment, the process variable is calculated using one of these monitored parameters.

In another preferred embodiment, the process variable is a parameter related to refiner energy, such as refiner energy, refiner power, motor load, refiner gap, refiner plate force, or hydraulic load or energy input. If desired, the process variable can be motor load, refiner gap, refiner plate force, hydraulic load or hydraulic energy input.

In step 244, the process variable is compared with the setpoint to determine whether to adjust the volumetric flow rate of stock in step 246. In one preferred implementation, the process variable is compared with the setpoint, and the flow rate is adjusted up or down depending on whether the process variable is greater than or less than the setpoint.

Figure 13:
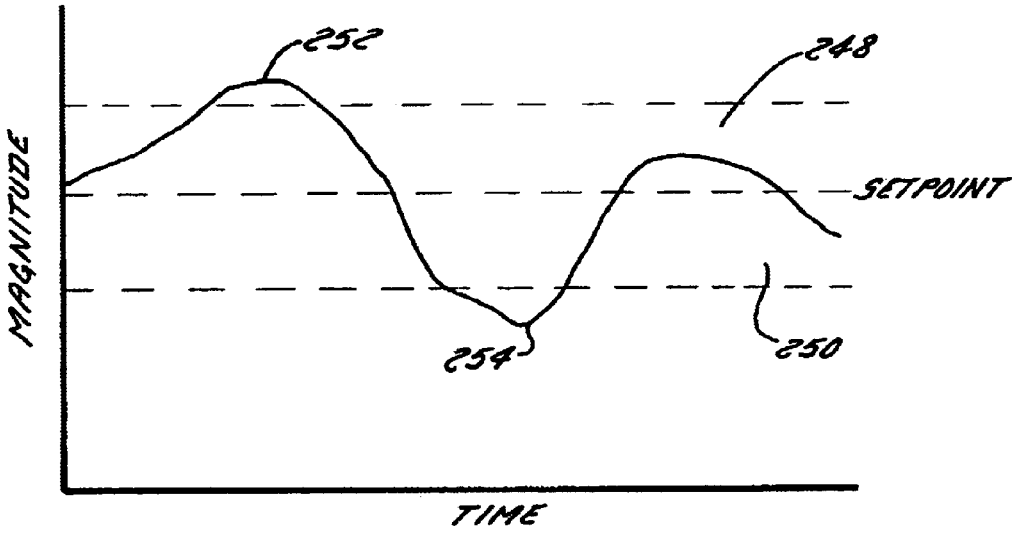
FIG. 13 is a graph depicting a tolerance or band around a process variable setpoint used in controlling refiner operation.

Referring to FIG. 13, in another preferred implementation, the process variable is compared with the setpoint and the volumetric flow rate is adjusted if the process variable fall outside a first band 248 that lies above the setpoint and a second band 250 that lies below the setpoint. Where the process variable fall outside band 248, such as where indicated by reference numeral 252, the volumetric flow rate of stock is increased or decreased to bring the process variable back within the band. Likewise, where the process variable fall outside band 250, such as where indicated by reference numeral 254, the volumetric flow rate of stock is conversely increased or decreased to bring the process variable back within the band.

Figure 14:
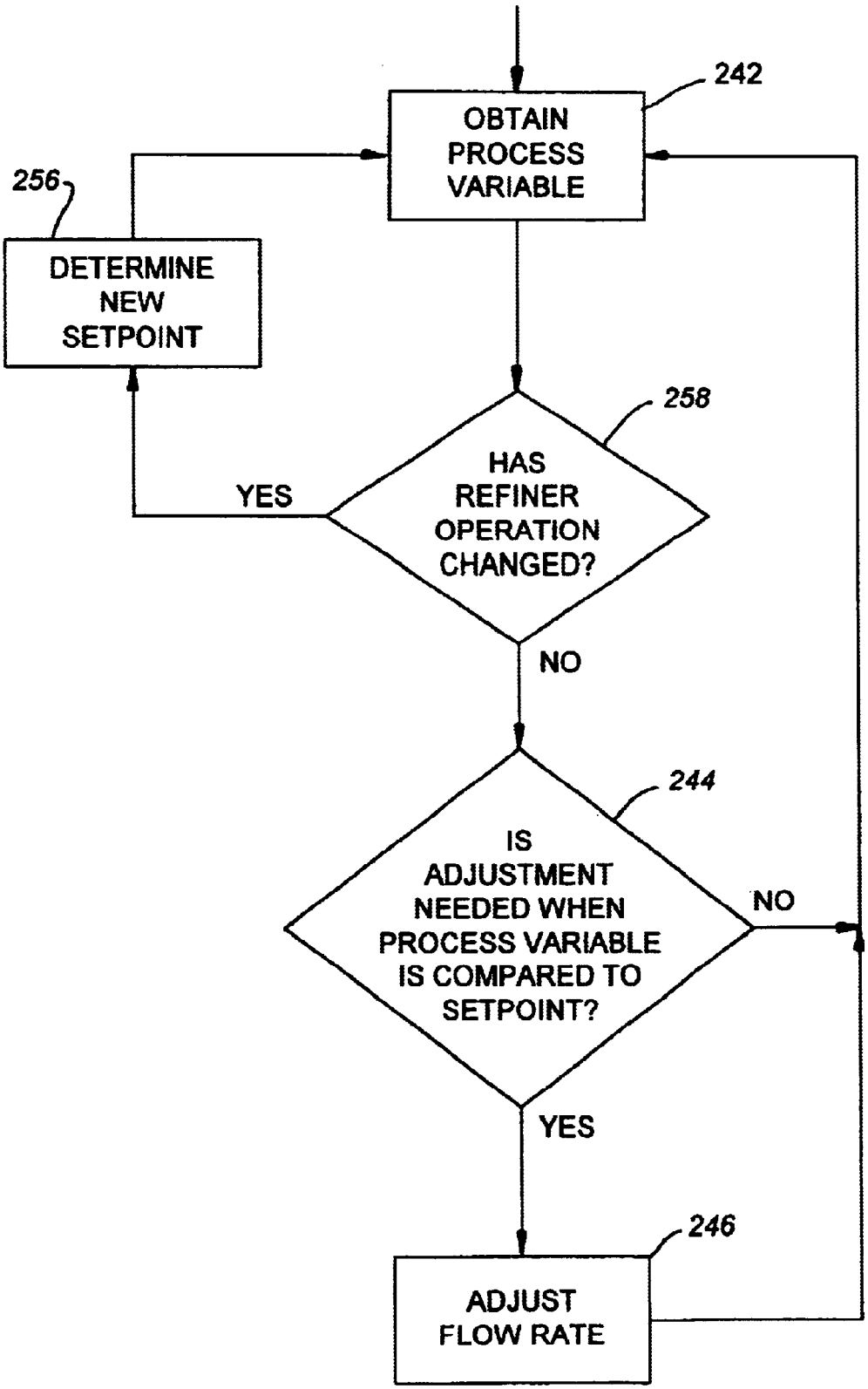
FIG. 14 depicts one preferred implementation of the control method.

FIG. 14 depicts an implementation of the control method where a new setpoint is determined at step 256 when it has been determined that refiner operation has been changed in step 258. For example, should an operator change some particular aspect of refiner operation, a new setpoint will be determined. A new setpoint will also be determined if the aspect of refiner operation that was changed was done so automatically. For example, where there is a DCS linked to the refiner, the DCS can change some aspect of operation, such as main motor speed, that will cause a new setpoint to be determined.

After the new setpoint has been determined at step 256, the controller 236 will resume obtaining the process variable and the rest of the algorithm shown in FIG. 14 will be carried out. So that refiner operation stabilizes, it can take some time for the new setpoint to be determined.

Figure 15:
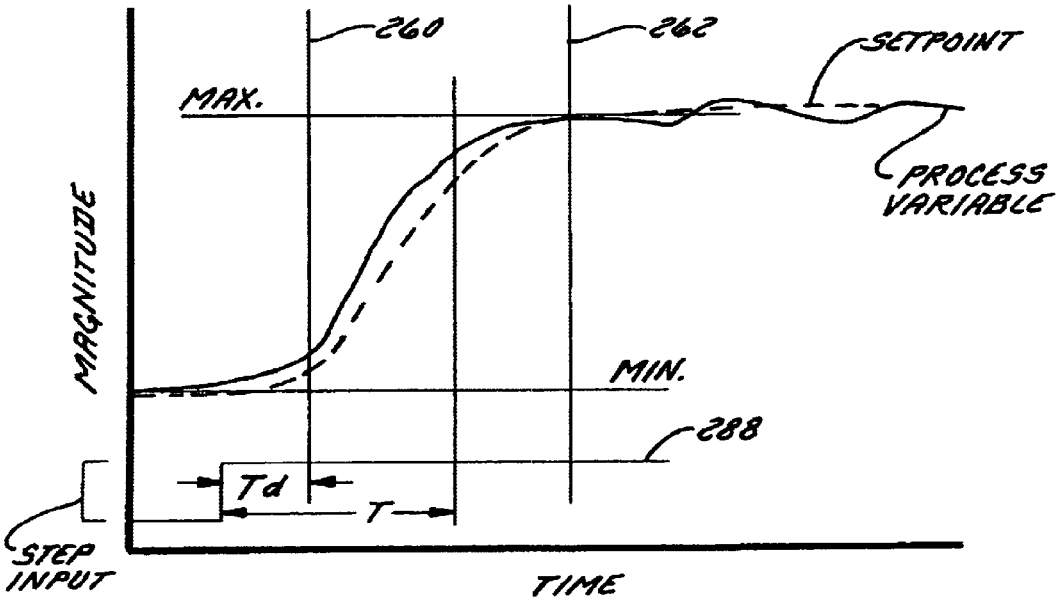
FIG. 15 is a graph illustrating a method of changing a process variable setpoint in response to a change in refiner operation.
Figure 16:
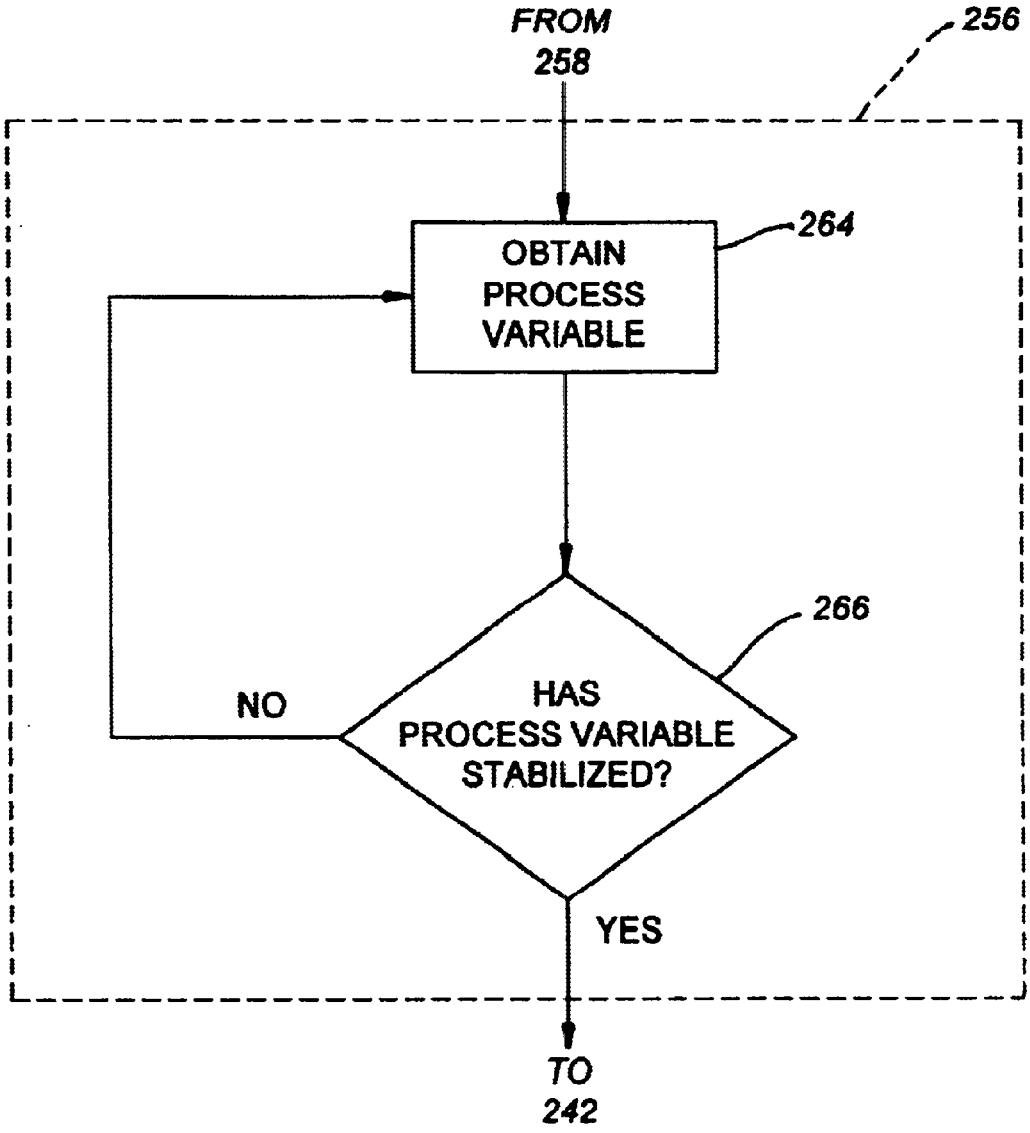
FIG. 16 is a schematic of a method of changing the setpoint in response to a change in refiner operation.

FIGS. 15 and 16 illustrate a preferred method of determining a new setpoint. The first vertical line labeled reference numeral 260 represents when refiner operation has been changed. The second vertical line labeled reference numeral 262 represents when the refiner operation has stabilized after the change and the new setpoint has been determined. Referring to FIG. 16, in one preferred implementation, the process variable is obtained in step 264, and the process variable obtained is analyzed to determine whether its magnitude over time has stabilized in step 266. In determining whether refiner operation has stabilized, successive process variables are analyzed to determine whether their change in slope is less than 5%.

In another method of determining whether refiner operation has stabilized, each process variable of a current cycle is compared to its value from the prior cycle for a number of cycles that can be two cycles in number, three cycles in number, or more. If the absolute value of the average of the current process variable value and its prior value for at least two cycles is compared, the process will have been deemed converged, i.e., steady state, if the averages fall within some acceptable tolerance. For example, where three consecutive temperatures are 171.5°, 170.5°, and 170.0°, and the tolerance 0.5°, convergence will not have occurred because the absolute value of the averages will not have fallen within the 0.5° tolerance. In another example, where the three consecutive temperatures are 170.5°, 170.0°, and 170.0°, and the tolerance 0.5°, convergence will have occurred because the absolute value of the averages will have fallen within the 0.5° tolerance. When it has been determined that refiner operation has stabilized, the controller is released, and its control over mass flow resumes.

Figure 17:
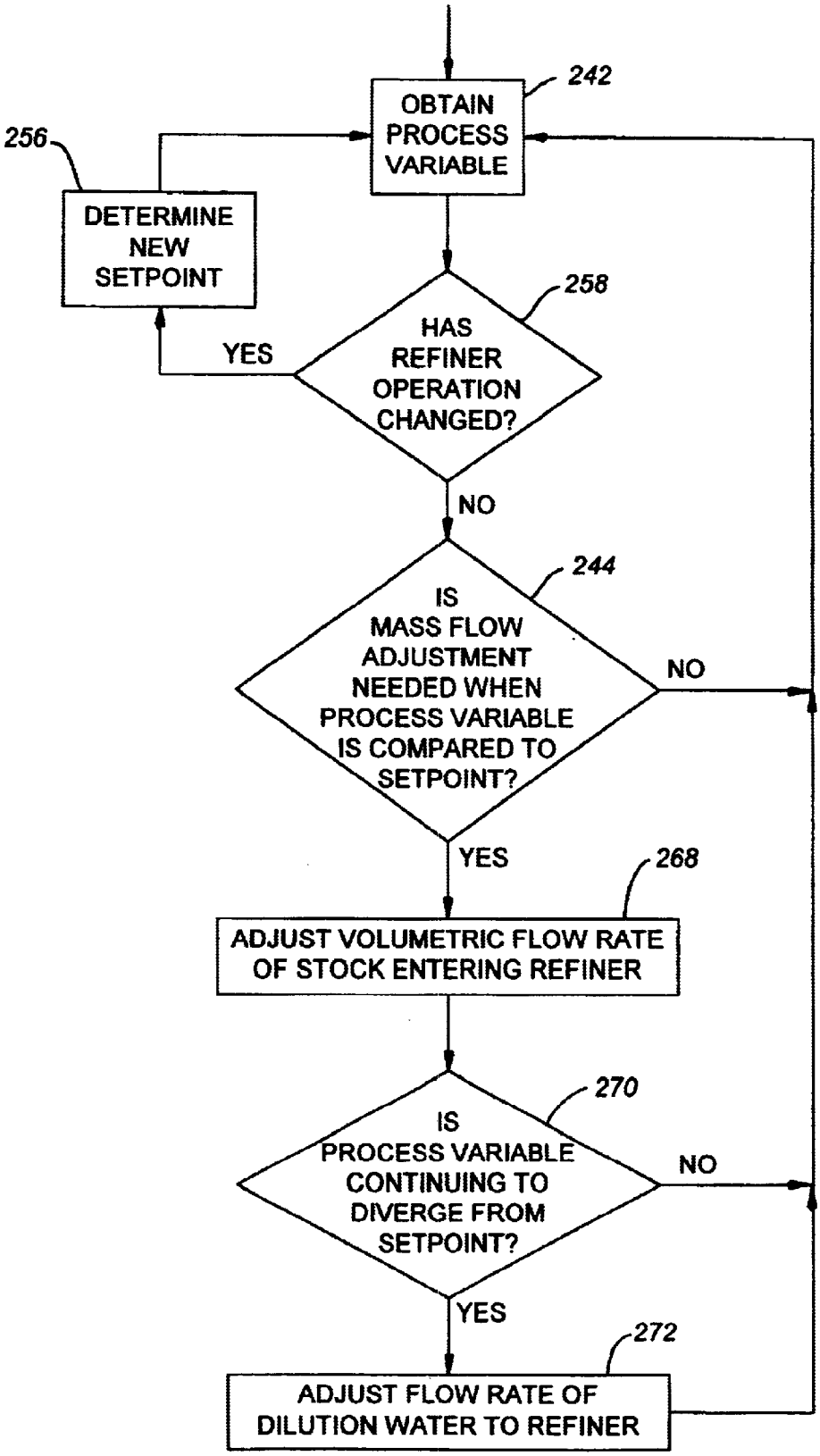
FIG. 17 is a schematic depicting a second preferred implementation of the control method.

FIG. 17 illustrates another flow chart of another preferred controller implementation. If it is determined in step 244 that an adjustment to mass flow is needed, the volumetric flow rate of the stock entering the refiner 32 is adjusted in step 268. For example, if the process variable has dropped below the setpoint such that adjustment is needed, the volumetric flow rate of stock entering the refiner 32 can be appropriately increased or decreased. If the process variable has risen above the setpoint such that adjustment is needed, the volumetric flow rate of stock entering the refiner 32 can be appropriately conversely increased or decreased.

As an example, where the process variable is a refiner temperature, such as temperature in the refining zone, the volumetric flow rate will be increased if the temperature has risen far enough above a setpoint temperature such that adjustment is needed. The volumetric flow rate will be decreased if the temperature has dropped far enough below the setpoint temperature such that adjustment is needed.

Changing the volumetric flow rate preferably is accomplished by speed up or slowing down the feed screw. Increasing the feed screw speed will increase the volumetric flow rate, and decreasing the feed screw speed will decrease the volumetric flow rate.

In some instances, changing the volumetric flow rate of stock entering the refiner will not have the desired affect of converging the process variable to its setpoint. This failure can be caused by changes in the mass flow rate of fiber entering the refiner that occur independently of the volumetric flow rate of the stock. It is believed that this occurs because the density of the fiber in the stock has changed, chip size has changed, chip moisture content has changed, the feed screw has become worn over time, process upsets have occurred upstream of the refiner that affect fiber mass flow, or due to other reasons that are often specific to the mill in which the refiner is installed.

To account for the possibility of the fiber mass flow rate changing independent of the volumetric flow rate of the stock, step 270 determines whether the process variable continues to diverge from the setpoint despite the volumetric flow rate of the stock having been adjusted in step 268. If it is determined that the process variable is diverging from the setpoint too much, the flow rate of the dilution water is adjusted in step 272.

For example, where the process variable continues to diverge despite adjustment of the stock mass flow rate by a certain amount or by a certain percentage, the dilution water flow rate will be changed. For example, if the process variable continues to diverge and goes outside of an acceptable band, the dilution water flow rate can be changed. Hence, if the process variable is greater than or less than the setpoint by a certain percentage, such as 5%, the dilution water flow rate can be adjusted.

The dilution water flow rate is increased or decreased depending on the direction of convergence of the process variable. Where the process variable is a refiner temperature, such as a temperature in the refining zone, the dilution water flow rate is increased if the temperature increases above the setpoint and continues to diverge from the setpoint such that dilution water flow rate adjustment is needed. Conversely, the dilution water flow rate is decreased or stopped if the temperature decreases below the setpoint and continues to diverge unacceptably from the setpoint. This relationship also holds true for refiner pressure, such as a pressure in the refining zone.

Figure 18:
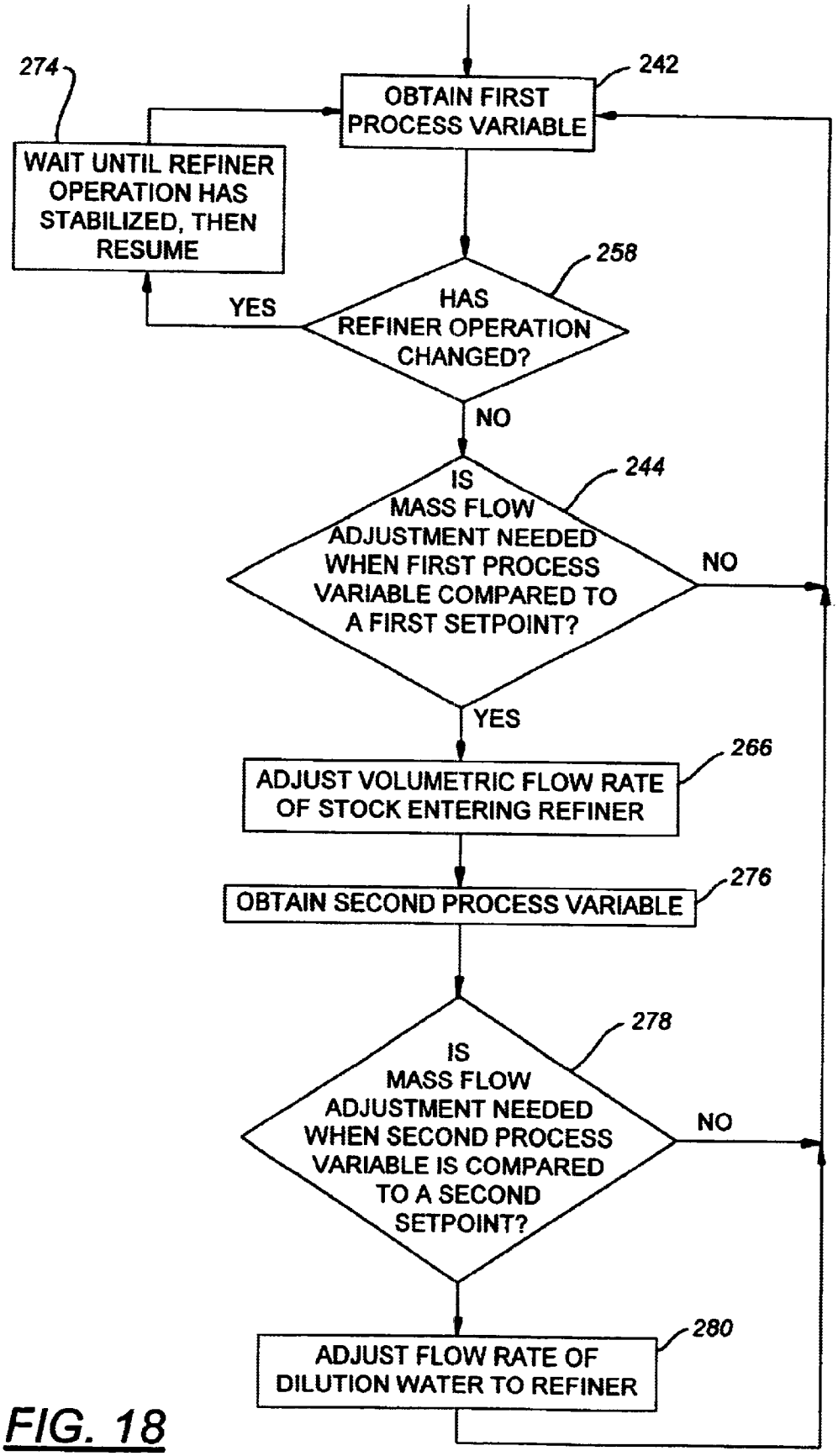
FIG. 18 is a schematic depicting a preferred implementation of the control method using two control loops that have two process variables that can be different.

FIG. 18 illustrates a still further preferred implementation of the control method. A first process variable is obtained in step 242. It is determined whether refiner operation has changed in step 258. If so, control is put on hold in step 274 until refiner operation stabilizes. Step 258 is not order dependent and can be performed anytime during execution of the control algorithm depicted in FIG. 18.

The first process variable and/or a second process variable can both be monitored to determine when one, the other, or both have reached a steady state value, such as in the manner depicted in FIGS. 15 and 16. When it has been determined that one or both process variables have reached a steady value, the steady state value is taken as the new setpoint and control resumes.

If refiner operation has not changed, the first process variable is compared against its setpoint in step 244 to determine whether the volumetric flow rate of stock entering the refiner should be adjusted. If so, the volumetric flow rate of the stock is changed in step 266. If not, the control algorithm branches to step 242 where the first process variable is once again obtained.

If the volumetric flow rate of the stock has been adjusted, a second process variable is obtained in step 276. If desired, both process variables can be determined at the same time or in a common control algorithm step.

The second process variable is compared against its setpoint in step 278 to determine whether an additional mass flow rate adjustment is needed. If so, the additional flow rate adjustment is performed in step 280. Preferably, the flow rate adjustment performed is an adjustment of the flow rate of dilution water to the refiner. If no flow rate adjustment is required, the control algorithm returns to obtain one or both process variables.

Figure 19:
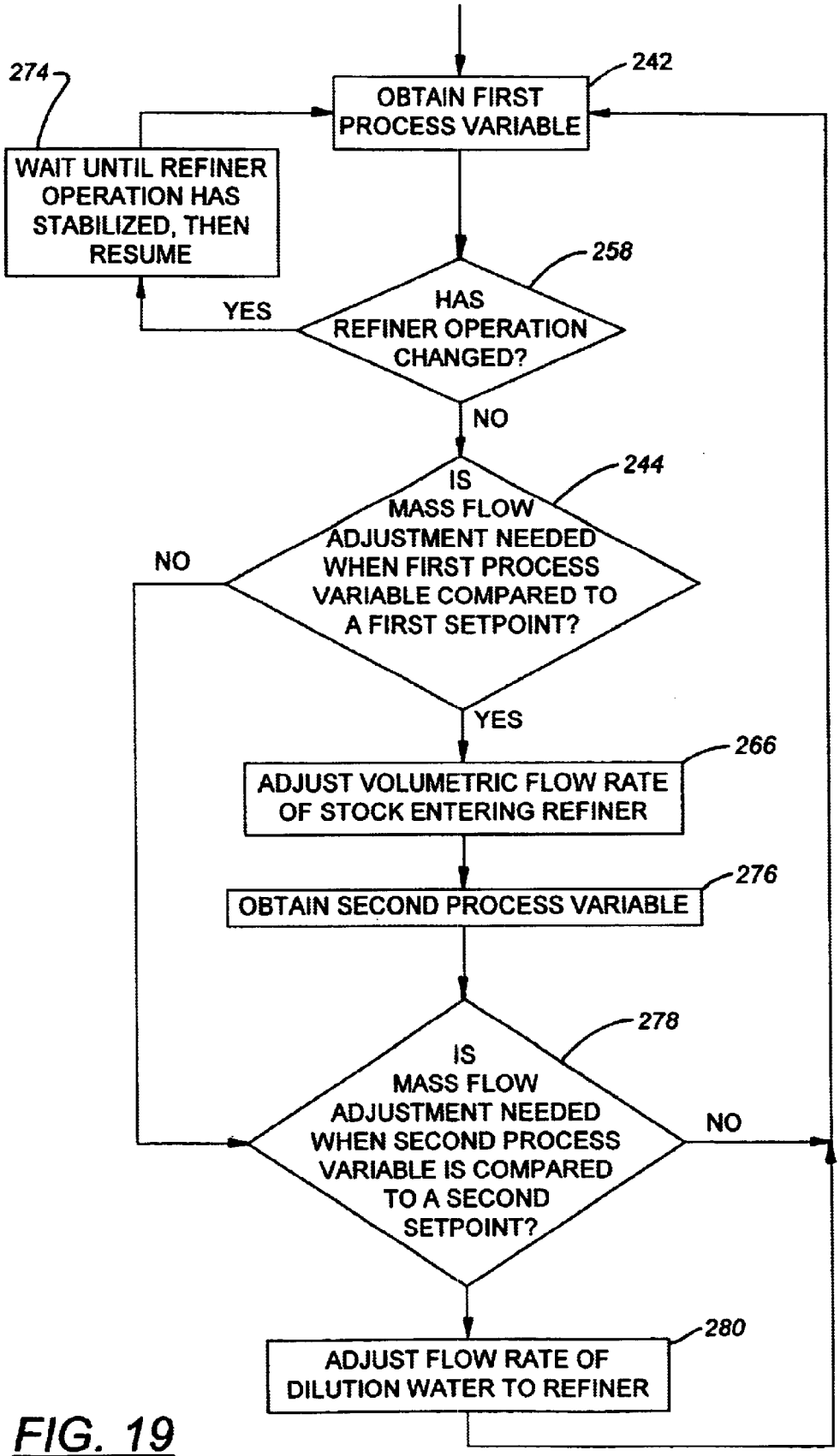
FIG. 19 is a schematic depicting a second preferred implementation of the control method using two control loops.

The control algorithm implementation depicted in FIG. 19 is similar to the control algorithm depicted in FIG. 18 except that the second process variable is compared against its setpoint in step 278 even if it has been determined that no mass flow rate adjustment is needed in step 244. This arrangement enables, for example, two control loops to be executed at the same time. It also enables two completely independent control loops to be used.

In one preferred implementation of the control algorithms depicted in FIGS. 18 and 19, the first process variable preferably is a refiner temperature or a refiner pressure and the second process variable preferably is consistency. Where refiner temperature and/or pressure are used as a process variable, a temperature or pressure in the refining zone preferably is obtained.

Figure 20:
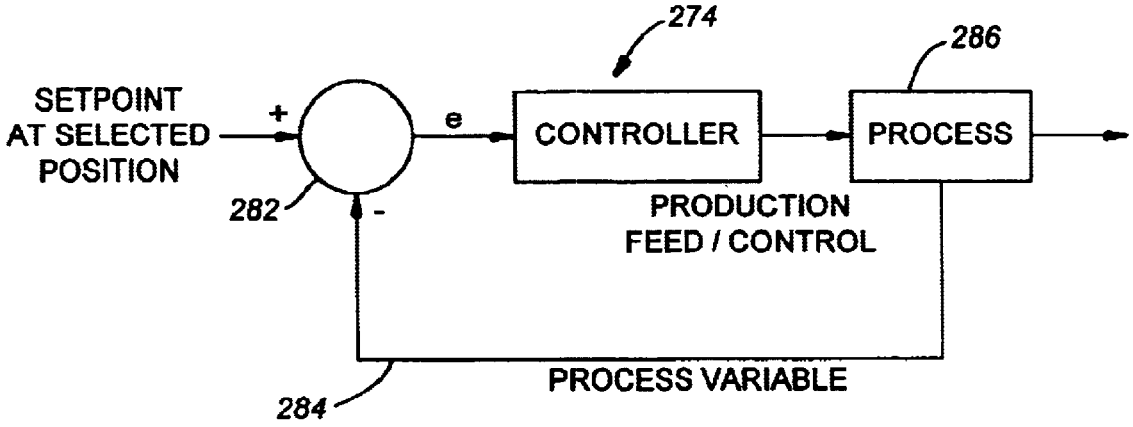
FIG. 20 is a control block diagram depicting one preferred implementation of the control method.

FIG. 20 illustrates a control block diagram of a preferred controller 274 that can be used with any of the preferred implementations previously discussed. While the controller can be a proportional controller, it preferably has at least a proportional component and an integral component. Where it is desirable to, for example, use feedforward control, the controller 274 can also have a derivative component.

At summing junction 282, the setpoint at the selected set of refiner operation conditions is summed with a process variable from a feedback loop 284 that is obtained from some parameter relating to the process 286 being controlled, namely refiner operation. The result of the summing junction produces e, which is set forth below:

$$e=SP-PV \qquad \text{(Equation I)}$$

where e is the error, SP is the value of the setpoint, and PV is the value of the process variable.

The equation that expresses the controller action is as follows:

$$u(t) = K_c\left(e + \frac{1}{T_i}\int_0^t e\,dt + T_d\frac{de}{dt}\right) \qquad \text{(Equation II)}$$

where u(t) is the controller output, $K_c$ is the controller gain, $T_i$ is the integral time constant in minutes, and $T_d$ is the derivative time constant in minutes. The proportional action of the controller can be expressed by the equation:

$$u_p(t)=K_c e \qquad \text{(Equation III)}$$

where $u_p(t)$ is the output of this portion of the controller. The integral action of the controller can be expressed by the equation:

$$u_I(t) = \frac{K_c}{T_i}\int_0^t e\,dt \qquad \text{(Equation IV)}$$

where $u_I(t)$ is the output of this portion of the controller. Where present, the derivative action of the controller can be expressed by the equation:

$$u_D(t) = K_c T_d\frac{de}{dt} \qquad \text{(Equation V)}$$

where $u_D(t)$ is the output of this portion of the controller.

The controller output, u(t), gets communicated as a control signal to the particular component being regulated by the controller. For example, where the component being regulated is the volumetric flow rate of stock, the control signal can be sent directly to a feed screw motor or motor controller that controls the feed screw speed. Where the system includes DCS, the signal preferably is sent to the DCS and causes the DCS to adjust the feed screw speed. Where the component is dilution water flow rate, the signal can be sent directly to a dilution water pump motor or motor controller that controls the dilution water pump. Where the system includes a DCS, the signal preferably is sent to the DCS and causes the DCS to adjust the dilution water flow rate. If desired, the output, u(t), can be processed further to produce the control signal or otherwise used in obtaining the control signal.

Because each refiner, stock system arrangement, and fiber processing plant is different, it is believed very likely that the controller will have to be tuned for the particular refiner it will be used to control. One preferred tuning method subjects the refiner to a step input and analyzes the response. More specifically, the controller is tuned to determine the controller gain, $K_c$, the integral time constant, $T_i$, and, where a derivative component is used, the derivative time constant, $T_d$, by analyzing system response in response to a step input. In one preferred controller, the controller is a proportional-integral controller that has no derivative control component.

For example, where the controller output, u(t), is used to control the volumetric flow rate of stock entering the refiner and the refiner temperature is the process variable, the parameters $K_c$, $T_d$, and $T_i$, can be determined by increasing the volumetric flow rate of stock by a step input of a specific magnitude and then monitoring how fast it takes for the refiner temperature to begin increasing, as well as how long it takes until before the temperature reaches a steady state condition and its magnitude at steady state. This information is used in determining the dead time, $TDE_{DEAD}$, of the system, the time constant, $T_i$, the process gain, K, and the controller gain, $K_c$. The dead time, $T_{DEAD}$, is used to determine the controller gain, $K_c$, and can be used to determine the time constant, $T_i$.

Where the output, u(t), is used to control the dilution water flow rate entering the refiner and consistency is the process variable, the parameters $K_c$, $T_d$, and $T_i$, can be determined by increasing the dilution water flow rate by a step input of a specific magnitude and then monitoring how fast it takes for the consistency to begin decreasing, as well as how long it takes until before the consistency reaches a steady state condition. The magnitude of the consistency at steady state is also determined. This information is used in determining the dead time, $T_{DEAD}$, of the system, the time constant, $T_i$, the process gain, K, and the controller gain, $K_c$.

In one preferred embodiment, the process variable is refiner temperature and the output of the controller is used to set the speed of the feed screw to control the volumetric flow rate of stock entering the refiner. The controller must be tuned for the specific refiner and fiber processing plant in which the refiner is installed.

In one preferred method of tuning the controller, the system dead time, $T_{DEAD}$, the time constant, $T_i$, of the system, and the process gain, K, are determined. In tuning the controller, the refiner is operated normally at a particular set of operating conditions until steady state operation is achieved. Referring to FIG. 15, where the feed screw speed is the controlled variable 288, the speed is then adjusted upwardly or downwardly by an amount (represented by the step in FIG. 15) that preferably is measured. Then, the time it takes from the moment of the adjustment for the change in feed screw speed (controlled variable) until temperature (process variable) is affected is measured. This amount of time, the lag between changing the output and the change affecting the process variable, is the dead time, $T_{DEAD}$.

Where refiner temperature is the process variable and the feed screw speed is being controlled, $T_{DEAD}$ can be as little as one second to as much as about two minutes, depending on the refiner, how far the feed screw is located from the refiner, and other factors. Typically, $T_{DEAD}$ is between about five seconds and about fifty seconds. Where consistency is the process variable and the dilution water flow rate is being controlled, $T_{DEAD}$ is less and typically is between one half second and five seconds.

Referring once again to FIG. 15, the time constant, $T_i$, is determined by measuring the time it takes for the process variable to reach about ⅔ (about 63.2%) of the difference between its minimum value and its maximum steady state value. Where temperature is the process variable and volumetric flow rate (feed screw speed) is the controlled variable, the time constant, $T_i$, ranges between 0.3 minute and 1.1 minute. Typically, the time constant, $T_i$, ranges between about 0.4 minute and about 0.75 minute. Where consistency is the process variable and dilution flow rate is the controlled variable, the time constant, $T_i$, is smaller and typically less than about 0.3 minute.

The controller gain, $K_c$, is determined or selected. $K_c$ preferably ranges between about 0.25 and about 2. Where the controller is a PID controller, the derivative time constant, $T_d$, can be set approximately equal to a rate of change of the process variable after the dead time has passed but before it has reached steady state.

In one preferred method of determining $K_c$, the process gain, K, is first determined and then used, along with the dead time, $T_{DEAD}$, and the time constant, $T_i$, to determine $K_c$. Referring to FIG. 15, K is the ratio of the change (or percent change) in the magnitude of the step input over the change (or percent change) in the magnitude of the output, i.e., max−min.

Where the controller is a PI controller, the following equation can be used to determine the proportional band, PB, in percent:

$$PB = 110\frac{KT_{DEAD}}{T_i} \quad \text{(Equation VI)}$$

The coefficient of 110 can be varied depending on the characteristics of the controller desired. The controller gain, Kc, is then determined using the following equation:

$$K_c = \frac{100}{PB} \quad \text{(Equation VII)}$$

Where this method is used, the following equation can be used to determine the time constant, $T_i$, in minutes:

$$T_i = 3.33T_{DEAD} \quad \text{(Equation VIII)}$$

Where the controller is a PID controller, the following equation can be used to determine the proportional band, PB, in percent:

$$PB = 80\frac{KT_{DEAD}}{T_i} \quad \text{(Equation IX)}$$

The coefficient of 110 can be varied depending on the characteristics of the controller desired. The controller gain, Kc, is determined in the manner set forth above in Equation VII. The following equation can be used to determine the integral time constant, $T_i$, in minutes:

$$T_i = 2.00T_{DEAD} \quad \text{(Equation X)}$$

The following equation can be used to determine the derivative time constant, $T_d$, in minutes:

$$T_d = 0.50T_{DEAD} \quad \text{(Equation XI)}$$

Figure 21:
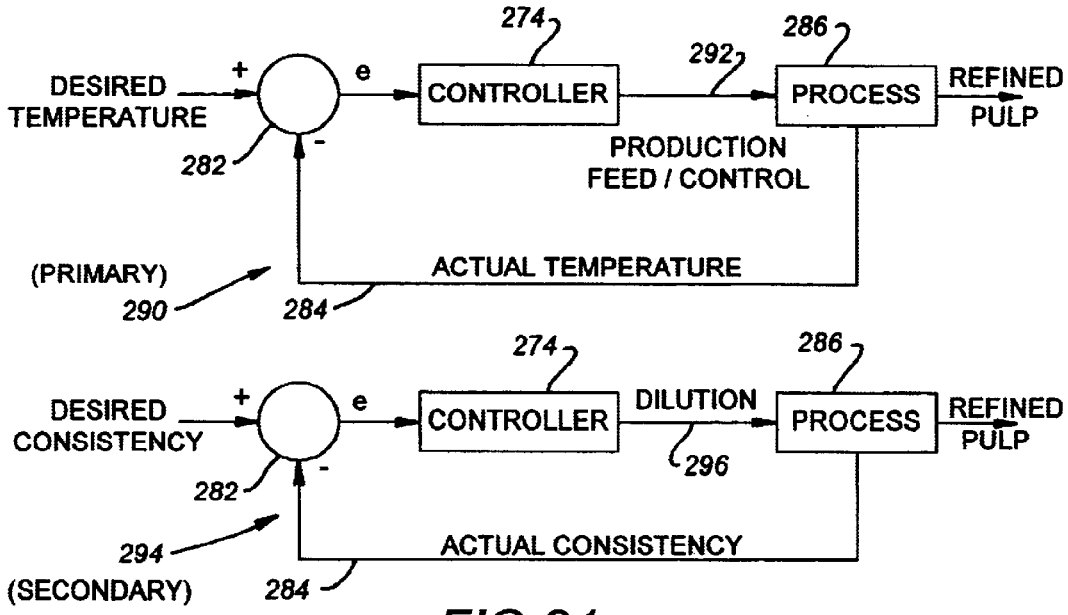
FIG. 21 is a control block diagram depicting a second preferred implementation of the control method having two control loops.

FIG. 21 depicts a pair of the controllers that control the same refiner. The process of the refiner being monitored in one controller arrangement, referred to by reference numeral 290, is an actual refiner temperature, preferably a temperature in the refining zone. Where there is more than one sensor, such as sensors 78, 180, 182, 184, 186, 188 and 190, from which an actual refining zone temperature can be obtained and used as the process variable 284, the refining zone temperature can be an average temperature, the temperature of a single selected sensor, or a temperature of the refining zone obtained using another method.

The actual temperature is summed at 282 with a desired temperature setpoint to obtain the process error value, e. The process error value, e, is fed into the controller 274. The controller 274 outputs a signal that is used to regulate the speed of the feed screw to regulate the volumetric flow rate of stock entering the refiner. Where the actual temperature has risen above the desired temperature, the controller 274 will output a signal 292, labeled "Production Feed/Control" in FIG. 21, that will decrease the speed of the feed screw to lessen the volumetric flow rate. Where the actual temperature has dropped below the desired temperature, the controller 274 will output a signal 292 that increases the speed of the feed screw to increase the volumetric flow rate.

The process variable of the refiner being monitored in the other controller arrangement, referred to by reference numeral 294, is a consistency measurement, referred to in FIG. 21 as "Actual Consistency." The measured consistency is summed at 282 with a desired consistency setpoint to obtain the process error value, e. The process error value, e, is fed into the controller 274. The controller 274 outputs a signal 296 that is used to control operation of the dilution water pump to regulate the flow rate of dilution water entering the refiner. Where the measured consistency has risen above the desired consistency, the controller 274 will output a signal 296, labeled "Dilution" in FIG. 21, that will increase the dilution water pump output to increase the dilution water flow rate. Where the actual consistency has dropped below the desired consistency, the controller 274 will output a signal 296 that decreases or stops the dilution water pump to thereby reduce the dilution water flow rate.

In another preferred method, the measured consistency is the process variable and the controller output is a control signal that controls or is used to control the feed screw speed to control the volumetric flow rate of stock entering the refiner. In a still further preferred method, at least one measured temperature, e.g., the actual temperature, in the refining zone is the process variable and the controller output is a control signal that controls or is used to control the flow of dilution water.

If desired, refiner energy or one of the aforementioned refiner energy related parameters can be used as the process variable in the second or secondary controller depicted in FIG. 21.

Where the refiner is a twin refiner, the first controller arrangement 290 preferably is used to control the volumetric mass flow rate of stock entering a primary refiner of the twin refiner. The process variable measured is temperature in a refining zone of the primary refiner. The second controller arrangement 294 is used to control the flow rate of dilution water into a secondary refiner of the twin refiner. The process variable measured is the consistency of the stock at the output of the primary refiner or the inlet of the secondary refiner of the twin refiner. Where consistency is measured in the refining zone, it can be measured in a refining zone of the primary refiner or the secondary refiner. Where consistency is measured in a refining zone of the secondary refiner, it preferably is measured adjacent where the stock enters the refining zone.

Where consistency is the process variable, the consistency can be measured using a conventional consistency sensor, such as an inline consistency sensor. Examples of suitable consistency measurement sensors include an infrared consistency sensor, a mechanical consistency sensor, or another type of consistency sensor. Where consistency is measured and used as a controller process variable, the consistency measured preferably is the consistency of the stock entering the refiner. In such an instance, the consistency sensor is located upstream of the refiner or located in the refiner such that it can measure the consistency of the stock entering the refiner. Where the consistency sensor is located outside the refiner, the sensor can be an inline sensor.

In one preferred method of measuring consistency, refiner temperature or pressure measurements are used along with measurements of other refiner parameters to measure consistency. This novel method of determining consistency and system used to determine consistency is based on an application of mass and energy balance to the pulp as it flows through the refiner. The moisture in the refiner is assumed to be an equilibrium mixture of water and steam and the temperature (and therefore, pressure) of the water-steam mixture assumed to vary with radial position through the refiner. Thus, the steam is assumed to be saturated throughout the refiner zone.

The inputs required for this computation are the temperature within the refiner zone (or pressure), the distribution of the motor load (specific power) within the refining zone, and the initial consistency. As output, consistency is provided as a function of radial position in the refiner.

The consistency determination procedure set forth below is well suited for use in control refiner operation, since the refining zone temperature, refiner load, dilutions, hydraulics, and other refiner parameters are measured in real time. Using this method of determining consistency in real time, monitoring and/or controlling refining zone consistency as a function of both time and space can be done.

The model is based on the following equations for conservation of mass and energy, respectively:

$$\frac{dC}{dr} = 2\pi r \frac{m_s}{\dot{m}} C^2 \qquad \text{(Equation XII–XIV)}$$

$$m_s = \frac{1}{L}\left(\overline{W} - \frac{\dot{m}}{2\pi r}\left[H_s + \frac{1-C}{C}H_l\right]\frac{dT}{dr}\right)$$

$$u(t) = K_c\left(e + \frac{1}{T_i}\int_0^t e\,dt + T_d\frac{de}{dt}\right)$$

The physical quantities that correspond to the variables above are listed in Table 1 below:

TABLE 1

| Symbol | Description | Units |
|---|---|---|
| C | Consistency | Dimensionless |
| $m_s$ | Specific steam generation rate | $Kg/m^2$-sec |
| $\dot{m}$ | Dry wood throughput | kg/sec |
| r | Radial position | m |
| L | Latent heat of steam | KJ/kg |
| $\overline{W}$ | Specific power | $KW/m^2$ |
| $H_s$ | Wood heat capacity | KJ/kg-° C. |
| $H_l$ | Water heat capacity | KJ/kg-° C. |
| T | Temperature | ° C. |

One or more of the following inputs preferably are used in the consistency determination: the refiner main motor power, the force exerted on the refiner disks urging them together (or hydraulic pressure or force), the dilution motor power of the refiner for each dilution pump, the refiner case pressure, the refiner inlet pressure, the chip washing water temperature, the dilution water temperature, as well as the gap between refiner disks.

The consistency, C, is determined as a function of radial position in the refining zone. The temperature, T, is a temperature of stock preferably in the refining zone or upstream of the refining zone. Where the temperature, T, is measured upstream of the refining zone, it preferably is measured slightly upstream of the refining, such as immediately before the location where stock enters the refining zone. If desired, the temperature, T, can be measured at the refiner inlet where stock enters the refiner. Where the temperature, T, is a temperature in the refining zone, it preferably is measured at or adjacent where stock enters the refining zone. The temperature, T, can be measured anywhere in the refining zone. Where a refiner has more than one opposed pair of refiner disks, the temperature, T, preferably is taken upstream of the radially innermost pair of refiner disks or in its refining zone.

Where a sensor refiner disk or disk segment 142 or 142' is used, temperature, T, can be a temperature measurement from a single sensor, such as sensor 180, 186, or 194, or an average temperature determined from temperature measurements taken from group of sensors, such as sensors 194, 192, and 190 (or all of the sensors). Where it is desired to measure temperature, T, in the refining zone adjacent where stock enters, sensor 190, 192, or 194 can be used. Preferably, the temperature measurement from sensor 194 is used in such a case.

If desired, the temperature, T, can be determined using a combination of a temperature of stock entering the refiner and a temperature of stock in the refining zone. One such example is an average temperature of the average of the temperature of stock entering the refiner and a temperature of stock in the refining zone.

The latent heat of steam, L, is obtained from steam tables known in the art. The latent heat, L, is obtained for the temperature, T, which is measured. The specific power, $\overline{W}$, is determined by dividing the power input into the refiner, typically in megawatts, by the refiner disk surface area, in square meters.

The specific steam generation rate, $m_s$, is determined using an energy balance that assumes that all energy inputted into the refiner is converted to heat. Thus, it is assumed that the specific power, $\overline{W}$, of the refiner is converted into heat and known steam tables (not shown) are used to determine the specific steam generation rate using this assumption.

Where implemented as part of an algorithm that is executed by a processor, one or more steam tables are utilized as lookup tables.

The wood heat capacity, $H_s$, is taken from a known wood heat capacity table based on the temperature of the chips measured before the stock enters the refiner. The water heat capacity, $H_l$, is also taken from a known table of water heat capacities and is based on the temperature of the water in the stock measured before the stock enters the refiner.

If the temperature, T, and the specific power, $\overline{W}$, are known as functions of radial position, the two equations above can be combined to produce a non-linear ordinary differential equation (ODE) of first order for the consistency, C. This equation is:

$$\frac{dC}{dr} = \frac{2\pi r\overline{W}C^2}{\dot{m}L} - \frac{1}{L}\left(H_s + \frac{1-C}{C}H_l\right)\frac{dT}{dr}C^2 \qquad \text{(Equation XV)}$$

This non-linear $1^{st}$ order ODE can be converted into a linear $1^{st}$ order ODE by noting that:

$$-\frac{1}{C^2}\frac{dC}{dr} = \frac{d}{dr}\left(\frac{1}{C}\right) = \frac{d}{dr}\left(\frac{1-C}{C}\right) \qquad \text{(Equation XVI)}$$

Accordingly, by defining a new variable Z as (1−C)/C, the following linear order $1^{st}$ order ODE results:

$$\frac{dZ}{dr} = \frac{H_l}{L}\frac{dT}{dr}Z + \frac{1}{L}\left(H_s\frac{dT}{dr} - \frac{2\pi r}{\dot{m}}\overline{W}\right) \qquad \text{(Equation XVII)}$$

This equation is of the general form:

$$\frac{dZ}{dr} = f(r)Z + g(r) \qquad \text{(Equation XVIII)}$$

From ODE theory, a general solution to the above equation is:

$$e(r)=Ae^{\int f(r)dr}+e^{\int f(r)dr}\int g(r)e^{-\int f(r)dr}dr \qquad \text{(Equation XIX)}$$

The solution for this specific problem is easily obtained upon substitution of the appropriate functions f(r) and g(r) into the equation above. A is an arbitrary constant that is determined from the initial condition, i.e., the value of consistency (and therefore Z) at the inlet to the refiner. The final solution for Z is given below $$Z(r) = Z(r_i)\left(\frac{L(r)}{L(r_i)}\right)^{\frac{H_l}{\beta}} + \frac{H_s}{H_l}\left[\left(\frac{L(r)}{L(r_i)}\right)^{\frac{H_l}{\beta}} - 1\right] - \frac{2\pi}{\dot{m}}L(r)^{\frac{H_l}{\beta}}\int r\overline{W}(r)L(r)^{\left(-\frac{H_l}{\beta}-1\right)}dr \qquad \text{(Equation XX)}$$

This solution is based on the assumption that the latent heat of steam is a linear function of temperature of the form:

$$L(r)\alpha+\beta T(r) \qquad \text{(Equation XXI)}$$

The inlet radius is $r_i$. Since the temperature and the specific power are obtained at discrete points, the quadrature (last term in the equation for Z) is a function of the fitting or interpolation procedure used to obtain the measured quantities as continuous functions of radial position. Once the fitting or interpolation functions are known, the integration can be carried out numerically.

Finally, the consistency can be obtained from Z(r) as:

$$C = \frac{1}{1+Z} \qquad \text{(Equation XXII)}$$

This method preferably is implemented in software to compute the consistency. A piecewise linear interpolation function preferably is used for the temperature and specific power functions, which provides the advantage that the quadrature in the functional representation of Z(r) can be exactly evaluated. Doing so, assumes that both the temperature and specific power data is available at the same radial locations.

Such a software-implemented algorithm preferably can compute the consistency as a function of radial position. Only one measurement of consistency, C, is needed by the controller shown in FIG. 21. In one preferred implementation of this method, the consistency, C, determined is the consistency at the inlet of the refining zone or adjacent a radial inward location of the refining zone.

Figure 22:
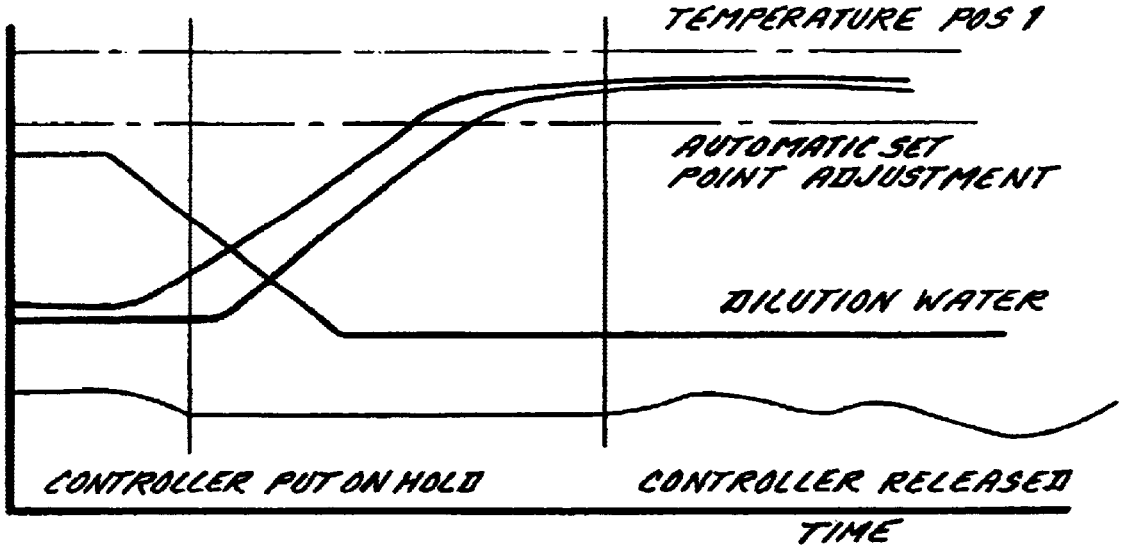
FIG. 22 is a graph illustrating a change in a refiner operating parameter putting a controller of the control method on hold and then releasing the controller when a process variable of the control method has stabilized.

FIG. 22 graphically illustrates a controller being put on hold when an operating parameter of the refiner is changed. The controller is released after the operating parameter has been changed and when its process variable has stabilized. For example, when the flow rate of the dilution water is changed, such as when an operator changes it or when a DCS changes it in response to a change in motor load, the controller is put on hold at the time designated by line 300. A link between the DCS and the control computer can communicate when such a refiner operating parameter has been changed and thereby cause the controller to be put on hold.

After the operating parameter change has been made, the refiner begins to stabilize. For example, where refiner temperature is the process variable, the temperature will change and then stabilize in the manner shown in FIG. 22. Where consistency is the process variable, it too will stabilize. When the process variable has sufficiently stabilized, its value when the stabilization determination is made is adopted as the new setpoint and the controller is released, such as at the time indicated by line 302. When released, the controller resumes operation.

The control processor 34 preferably is configured with the control method of this invention or a preferred implementation of the control method. The control method preferably is implemented in software on board the control processor 34. Preferably, the control method is implemented in the form of a controller that preferably is a PI controller or a PID controller.

It is also to be understood that, although the foregoing description and drawings describe and illustrate in detail one or more preferred embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

What is claimed is:

1. A control system for a rotary disk pulp refiner that has a refining zone between a pair of opposed refiner disks, each equipped with a refining surface, between which a fibrous stock slurry is processed during rotary disk refiner operation, the refiner control system comprising:

a sensor carried by one of the refiner disks from which a signal is obtainable that is related to a characteristic of stock in refining zone during refiner operation;

a controller (a) that regulates a controlled variable that affects operation of the refiner in response to a process variable that is related to the characteristic of stock in the refining zone obtained from the signal of the sensor and (b) which is configured (i) to pause regulation after a change is made to the controlled variable until steady-state refiner operation is achieved, and (ii) thereafter resume regulation of the controlled variable in response to the process variable.

2. The pulp refiner control system of claim 1 further comprising a conveyor that introduces a stock slurry of liquid and fiber into the rotary disk refiner at a volumetric flow rate and wherein the controlled variable that is regulated by the controller comprises the volumetric flow rate of the stock slurry.

3. The pulp refiner control system of claim 2 further comprising a motor that drives the conveyor and wherein the controller regulates the volumetric flow rate of the stock slurry by controlling the motor.

4. The pulp refiner control system of claim 3 wherein the conveyor comprises a feed screw driven by the motor, wherein the motor operates at a speed that can be varied, and wherein the controller regulates the volumetric flow rate of the stock entering the refiner by regulating the speed of the motor that drives the feed screw.

5. The pulp refiner control system of claim 1 wherein the sensor comprises a temperature sensor that senses a temperature of the rotary disk refiner that is used in obtaining the process variable.

6. The pulp refiner control system of claim 1 wherein the sensor comprises a thermocouple disposed in a thermally conductive housing that is embedded in the refining surface of one of the refiner disks such that the thermally conductive housing is directly exposed to stock in the refining zone while preventing stock from directly contacting the thermocouple, wherein a free end of the housing is disposed below a top surface of an adjacent refiner bar of the refining surface, and wherein the characteristic of stock in the refining zone is a temperature of stock in the refining zone.

7. The pulp refiner control system of claim 6 further comprising an insulating ceramic spacer disposed between the thermally conductive housing and the one of the refiner disks.

8. The pulp refiner control system of claim 1 wherein the sensor comprises a pressure sensor and the sensed parameter is a pressure in the refiner.

9. The pulp refiner control system of claim 1 wherein the sensor comprises a pressure sensor that is disposed in the refining surface of one of the refiner disks and the sensed parameter is a pressure of stock in the refining zone.

10. The pulp refiner control system of claim 1 wherein the sensor is disposed in the refining surface of one of the refiner disks and is exposed to stock slurry in the refining zone.

11. The pulp refiner control system of claim 1 further comprising a pump that introduces dilution water into the rotary disk refiner at a flow rate that can be varied, wherein the controlled variable that is regulated by the controller comprises the flow rate of the dilution water, and further comprising a sensor carried by the rotary disk refiner that provides a sensed temperature or a sensed pressure that is used in obtaining the process variable.

12. The pulp refiner control system of claim 11 wherein the rotary disk refiner comprises a pair of spaced apart and opposed refiner disks that each have a refining surface and a refining zone disposed between the refiner disks, wherein the sensor is disposed in the refiner and senses a pressure or temperature in the refining zone, and the process variable is obtained based upon the sensed pressure or the sensed temperature.

13. The pulp refiner control system of claim 12 wherein the sensor is disposed in the refining surface of one of the refiner disks and is exposed to stock in the refining zone.

14. The pulp refiner control system of claim 12 wherein the process variable that is obtained based upon the sensed pressure or the sensed temperature is a consistency of stock that passes through the rotary disk refiner.

15. The pulp refiner control system of claim 1 further comprising a pump that introduces dilution water into the rotary disk refiner at a flow rate that can be varied, wherein the controlled variable that is regulated by the controller comprises the flow rate of the dilution water, and further comprising a sensor that provides a consistency measurement used in obtaining the process variable.

16. The pulp refiner control system of claim 15 wherein the process variable is the consistency measurement.

17. The pulp refiner control system of claim 1 further comprising a pump that introduces dilution water into the rotary disk refiner at a flow rate that can be varied, a feed screw driven by the motor, wherein the feed screw conveys a stock slurry of liquid and fiber into the rotary disk refiner at a volumetric flow rate that depends upon the speed of the motor, wherein there are at least two controlled variables that are independently regulated with one of the controlled variables that is regulated by the controller comprising the volumetric flow rate of stock entering the refiner, and another one of the controlled variables that is regulated by the controller comprising the flow rate of the dilution water.

18. The pulp refiner control system of claim 17 wherein there are at least two process variables with one of the process variables associated with the one of the controlled variables and comprising at least one of a refiner temperature and a refiner pressure, and another one of the process variables associated with the another one of the controlled variables and comprising a consistency measurement.

19. A method of controlling operation of a rotary disk refiner having a pair of spaced apart and opposed refiner disks that each have a refining surface and a refining zone disposed between the refiner disks comprising:

(a) providing a feed screw driven by a motor whose speed can be varied to change a volumetric flow rate of a stock slurry of a liquid and fibrous matter that has a mass flow rate of fiber and that enters the rotary disk refiner, a pump that provides a flow rate of a dilution water to the rotary disk refiner that can be varied to vary the dilution water flow rate, a control processor linked to the refiner that is configured with a controller having a process variable;

(b) controlling the mass flow rate of the fiber entering the rotary disk refiner;

(c) making a change to the operation of the rotary disk refiner;

(d) pausing the controlling of the mass flow rate when the change is made to the operation of the rotary disk refiner;

(e) determining a new process variable setpoint; and (f) resuming control of the mass flow rate.

20. The control method of claim 19 wherein the process variable is based on stock consistency.

21. The control method of claim 20 wherein the process variable comprises a consistency of stock in the refining zone.

22. The method of control of claim 19 wherein during step (e) the new process variable setpoint is determined by setting it equal to a value of the process variable when the process variable has reached a steady state condition after making the change in the operation of the rotary disk refiner in step (c).

23. A method of controlling operation of a rotary disk refiner comprising:

(a) providing a controller that affects refiner operation using at least one process variable that is compared to a process variable setpoint, a conveyor that introduces a stock slurry of liquid and fiber into the rotary disk refiner, and a pump that provides dilution water to the rotary disk refiner; and (b) controlling operation of the conveyor by comparing a first of the at least one process variable with its associated process variable setpoint thereby regulating how much stock is entering the rotary disk refiner during refiner operation;

(c) controlling operation of the dilution water pump by comparing a second of the at least one process variable with its associated process variable setpoint thereby regulating how much dilution water is introduced into the stock entering the rotary disk refiner during refiner operation;

(e) pausing controlling operation of the conveyor and pausing controlling operation of the dilution water pump when or after a change has been made in at least one of the operation of the conveyor and the dilution water pump;

(f) determining a new process variable setpoint for at least one of the process variables; and (g) resuming controlling operation of the conveyor and dilution water pump in steps (b) and (c).

24. The method of control of claim 23 wherein during step (e) the new process variable setpoint is determined by setting it equal to a value of the process variable when the process variable has reached a steady state condition after making the change in the operation of the rotary disk refiner in step (c).

25. A method of controlling operation of a rotary disk refiner comprising:

(a) providing a drive linked to the rotary disk refiner that urges a stock slurry of liquid and fiber into the rotary disk refiner and a controller that affects refiner operation in response to a process variable that relates to a pressure or temperature in the refining zone by comparing it to a process variable setpoint;

(b) controlling a mass flow rate setting of the mass flow rate of fiber entering the rotary disk refiner;

(c) comparing the process variable to the process variable setpoint;

(d) changing the mass flow rate setting so as to keep the process variable at or within an acceptable range of the process variable setpoint;

(e) pausing controlling of the mass flow rate setting;

(f) resuming controlling the mass flow setting in step (b);

(d) determining a new process variable setpoint based on a present value of the process variable.

26. A method of controlling operation of a rotary disk refiner comprising:

(a) providing a drive linked to the rotary disk refiner that urges a stock slurry of liquid and fiber into the rotary disk refiner and a controller that affects refiner operation in response to a process variable that relates to a pressure or temperature in the refining zone by comparing it to a process variable setpoint during refiner operation; and (b) controlling a flow of the liquid entering the rotary disk refiner;

(c) comparing the process variable to the process variable setpoint;

(d) changing the mass flow rate setting so as to keep the process variable at or within an acceptable range of the process variable setpoint;

(e) pausing controlling of the mass flow rate setting;

(f) resuming controlling the mass flow setting in step (b);

(d) determining a new process variable setpoint based on a present value of the process variable.

27. A method of controlling operation of a rotary disk refiner having a pair of spaced apart and opposed refiner disks that each have a refining surface and a refining zone disposed between the refiner disks comprising:

(a) providing a feed screw driven by a motor whose speed can be varied to change a volumetric flow rate of a stock slurry of a liquid and fibrous matter that has a mass flow rate of fiber and that enters the rotary disk refiner, a pump that provides a flow rate of a dilution water to the rotary disk refiner that can be varied to vary the dilution water flow rate, a control processor in communication with the refiner that is configured with a controller having a process variable, and a sensor disposed adjacent the refining zone providing a signal upon which the process variable is based;

(b) rotating one of the refiner disks;

(c) introducing stock into a refining zone between the refiner disks;

(d) controlling the mass flow rate of the fiber entering the rotary disk refiner based on the process variable;

(e) pausing the controlling of the mass flow rate after a change to the mass flow rate has been made in step (d); and (f) resuming the controlling of the mass flow rate after the process variable stabilizes.

28. A method of controlling operation of a rotary disk refiner having a pair of spaced apart and opposed refiner disks that each have a refining surface and a refining zone disposed between the refiner disks comprising:

(a) providing a feed that can be varied to change a flow rate of a stock slurry of a liquid and fibrous matter that enters the rotary disk refiner, a pump that provides a flow rate of a dilution water to the rotary disk refiner that can be varied to vary the dilution water flow rate, a control processor in communication with the refiner that is configured with a controller having a process variable, and a sensor disposed adjacent the refining zone that sense a parameter in the refining zone upon which the process variable is based;

(b) rotating one of the refiner disks;

(c) introducing stock into a refining zone between the refiner disks;

(d) sensing a parameter in the refining zone;

(e) varying a flow rate of the stock slurry of liquid and fibrous matter entering the rotary disk refiner based on the process variable;

(f) pausing the varying of the stock slurry flow rate after a change to the stock slurry flow rate has been made in step (e);

(f) resuming the varying of the stock slurry flow rate in step (e) after the process variable reaches a steady-state condition.

29. A method of controlling operation of a rotary disk refiner having a pair of spaced apart and opposed refiner disks that each have a refining surface and a refining zone disposed between the refiner disks comprising:

(a) providing a feed screw driven by a motor whose speed can be varied to change a volumetric flow rate of a stock slurry of a liquid and fibrous matter that has a mass flow rate of fiber and that enters the rotary disk refiner, a pump that provides a flow rate of a dilution water to the rotary disk refiner that can be varied to vary the dilution water flow rate, a control processor in communication with the refiner that is configured with a controller having a process variable and a setpoint, and a sensor disposed adjacent the refining zone that sense a parameter in the refining zone upon which the process variable is based;

(b) rotating one of the refiner disks;

(c) introducing stock into a refining zone between the refiner disks;

(d) sensing a parameter in the refining zone;

(e) determining a process variable based on the parameter sensed;

(f) determining a value of the setpoint;

(g) controlling the speed of the feed screw by the controller to regulate the flow rate of stock entering the rotary disk refiner based on the process variable and the setpoint;

(h) making a change in the operation of the rotary disk refiner;

(i) pausing the controlling of the speed of the feed screw by the controller until another value can be determined for the setpoint;

(j) determining another value for the setpoint; and (k) resuming the controlling the speed of the feed screw by the controller to regulate the flow rate of stock entering the rotary disk refiner based on the process variable and the another value of the setpoint determined in step (j).

30. A method of controlling operation of a rotary disk refiner having a pair of spaced apart and opposed refiner disks that each have a refining surface and a refining zone disposed between the refiner disks comprising:

(a) providing a feed whose speed can be varied to change a flow rate of a stock slurry of a liquid and fibrous matter that enters the rotary disk refiner, a pump that provides a flow rate of a dilution water to the rotary disk refiner that can be varied to vary the dilution water flow rate, a control processor in communication with the refiner that is configured with a controller having a process variable, and a sensor disposed adjacent the refining zone that senses temperature in the refining zone upon which the process variable is based;

(b) rotating one of the refiner disks relative to another one of the refiner disks;

(c) introducing stock into a refining zone between the refiner disks;

(d) sensing a temperature in the refining zone;

(e) determining a process variable based on the temperature sensed;

(f) controlling the speed of the feed by comparing the process variable to a process variable setpoint or a range about the process variable setpoint to regulate the flow rate of stock or fiber entering the rotary disk refiner;

(g) pausing the controlling the speed of the feed after a change to the speed of the feed has been made in step (f) until the process variable subsequently reaches a steady-state condition;

(h) resuming the controlling the speed of the feed after the process variable has reached steady-state; and (i) setting the process variable setpoint to that of the process variable at or after the process variable has reached steady-state.

31. A method of controlling operation of a rotary disk refiner having a pair of spaced apart and opposed refiner disks that each have a refining surface and a refining zone disposed between the refiner disks comprising:

(a) providing a feed whose speed can be varied to change a flow rate of a stock slurry of a liquid and fibrous matter that enters the rotary disk refiner, a pump that provides a flow rate of a dilution water to the rotary disk refiner that can be varied to vary the dilution water flow rate, a control processor in communication with the refiner that is configured with a controller having a process variable and a setpoint, and a sensor disposed adjacent the refining zone that senses temperature in the refining zone upon which the process variable is based;

(b) rotating one of the refiner disks relative to another one of the refiner disks;

(c) introducing stock into a refining zone between the refiner disks;

(d) sensing a temperature in the refining zone;

(e) determining a process variable based on the temperature sensed;

(f) controlling the speed of the feed in response to the process variable and a setpoint to regulate the flow rate of stock or fiber entering the rotary disk refiner;

(g) making a change to some aspect of operation of the rotary disk refiner;

(h) pausing controlling the speed of the feed in step (f) until another setpoint is ascertained; and then (i) resuming controlling the speed of the feed in step (f).

32. A method of controlling operation of a rotary disk refiner having a pair of spaced apart and opposed refiner disks that each have a refining surface and a refining zone disposed between the refiner disks comprising:

(a) providing a feed screw driven by a motor whose speed can be varied to change a volumetric flow rate of a stock slurry of a liquid and fibrous matter that has a mass flow rate of fiber and that enters the rotary disk refiner, a pump that provides a flow rate of a dilution water to the rotary disk refiner that can be varied to vary the dilution water flow rate, a control processor in communication with the refiner that is configured with a controller having a process variable, and a sensor disposed adjacent the refining zone that senses pressure in the refining zone upon which the process variable is based;

(b) rotating one of the refiner disks;

(c) introducing stock into a refining zone between the refiner disks;

(d) sensing a pressure in the refining zone;

(e) determining a process variable based on the pressure sensed; and (f) controlling the speed of the feed screw to regulate the flow rate of stock or fiber entering the rotary disk refiner based on the process variable in relation to a process variable setpoint or range thereof;

(g) pausing the controlling the speed of the feed screw after a change to the speed of the feed screw has been made in step (f) until the process variable subsequently reaches a steady-state condition;

(h) resuming the controlling the speed of the feed screw after the process variable has stabilized; and (i) setting the process variable setpoint to that of the process variable at or after the process variable has stabilized.

33. A method of controlling operation of a rotary disk refiner having a pair of spaced apart and opposed refiner disks that each have a refining surface and a refining zone disposed between the refiner disks comprising:

(a) providing a flow rate of a stock slurry of liquid and fiber that enters the rotary disk refiner, a pump that provides a flow rate of a dilution water to the rotary disk refiner that can be varied to vary the dilution water flow rate, a control processor in communication with the refiner that is configured with a controller having a process variable and a setpoint, and a sensor disposed adjacent the refining zone that senses a parameter in the refining zone upon which the process variable is based;

(b) rotating one of the refiner disks relative to another one of the refine disks;

(c) introducing stock into a refining zone between the refiner disks;

(d) sensing a parameter in the refining zone;

(e) determining a process variable based on the parameter sensed;

(f) determining a value of the setpoint;

(g) controlling the flow rate of stock entering the rotary disk refiner by the controller based on the process variable and the setpoint;

(h) making a change in the operation of the rotary disk refiner;

(i) pausing the controlling of the flow rate of stock entering the rotary disk until another value can be determined for the setpoint;

(j) determining another value for the setpoint; and (k) resuming the controlling of the flow rate of stock entering refiner based on the process variable and the another value of the setpoint determined in step (j).

34. A method of controlling operation of a rotary disk refiner having a pair of spaced apart and opposed refiner disks that each have a refining surface and a refining zone disposed between the refiner disks comprising:

(a) providing a flow rate of a stock slurry of liquid and fiber that enters the rotary disk refiner, a pump that provides a flow rate of a dilution water to the rotary disk refiner that can be varied to vary the dilution water flow rate, a control processor in communication with the refiner that is configured with a controller having a process variable and a setpoint, and a sensor disposed adjacent the refining zone that senses a parameter in the refining zone upon which the process variable is based;

(b) rotating one of the refiner disks relative to another one of the refine disks;

(c) introducing stock into a refining zone between the refiner disks;

(d) sensing a parameter in the refining zone;

(e) determining a process variable based on the parameter sensed;

(f) determining a value of the setpoint;

(g) controlling the flow rate of stock entering the rotary disk refiner by the controller based on the process variable and the setpoint;

(h) making a change in the operation of the rotary disk refiner;

(i) pausing the controlling of the flow rate of stock entering the rotary disk;

(j) determining another value for the setpoint by setting it equal to a value of the process variable when the process variable has reached a steady state condition; and (k) resuming the controlling of the flow rate of stock entering refiner based on the process variable and the another value of the setpoint determined in step (j).

35. A method of controlling operation of a rotary disk refiner having a pair of spaced apart and opposed refiner disks that each have a refining surface and a refining zone disposed between the refiner disks comprising:

(a) providing a flow rate of a stock slurry of liquid and fiber that enters the rotary disk refiner, a pump that provides a flow rate of a dilution water to the rotary disk refiner that can be varied to vary the dilution water flow rate, a control processor in communication with the refiner that is configured with a controller having a process variable and a setpoint, and a sensor that senses a refiner energy related parameter upon which the process variable is based;

(b) rotating one of the refiner disks relative to another one of the refine disks;

(c) introducing stock into a refining zone between the refiner disks;

(d) sensing a refiner energy related parameter;

(e) determining a process variable based on the refiner energy related parameter sensed;

(f) determining a value of the setpoint;

(g) controlling the flow rate of stock entering the rotary disk refiner by the controller based on the process variable and the setpoint;

(h) making a change in the operation of the rotary disk refiner;

(i) pausing the controlling of the flow rate of stock entering the rotary disk for a period of time;

(j) determining another value for the setpoint; and (k) resuming the controlling of the flow rate of stock entering refiner based on the process variable and the another value of the setpoint determined in step (j).

36. A control system for a rotary disk pulp refiner that has a refining zone between a pair of opposed refiner disks, each refiner disk equipped with a refining surface, between which a flow of stock of fibrous slurry passes during refiner operation, the refiner control system comprising:

at least one sensor used to sense a physical property of the stock; and a processor configured (a) to determine a process variable value using information from the at least one sensor; (b) configured with a controller that adjusts one of Fiber mass flow rate and dilution water flow rate to the refiner in response to the value of the process variable relative a process variable setpoint or process variable setpoint range, (c) configured to pause the controller if a change is made to refiner operation to allow the refiner to stabilize, and (d) configured to release the controller thereafter.

37. A rotary disk pulp refiner control system according to claim 36 wherein the processor comprises a computer, the processor is configured to pause the controller in (c) after an adjustment is made to either the fiber mass flow rate or the dilution water flow rate, and the at least one sensor comprises a consistency sensor, a temperature sensor, or a pressure sensor disposed in the pulp refiner.

38. A control system for a rotary disk pulp refiner that has a refining zone between a pair of opposed refiner disks, each refiner disk equipped with a refining surface, between which a flow of stock of fibrous slurry passes during refiner operation, the refiner control system comprising:

at least one sensor used to sense a physical property of the stock; a processor configured to derive or obtain at least one process variable value from the at least one sensor:

a first controller configured to adjust one of fiber mass flow rate and dilution water flow rate to the refiner in response to a process variable value relative to a first setpoint or first setpoint range:

a second controller that is configured to adjust the other one of fiber mass flow rate and dilution water flow rate to the refiner in response to a process variable value relative a second setpoint or second setpoint range; and wherein the processor comprises a computer that is configured with the first controller and the second controller, at least one sensor comprises (i) a pressure sensor or temperature sensor used in deriving a stock pressure or stock temperature that is a first process variable used by the first controller and (ii) a consistency sensor used in deriving a stock consistency that is a second process variable used by the second controller, the processor is further configured to pause the first controller when adjustment to one of fiber mass flow rate and dilution water flow rate is being made, and the processor is further configured to pause the first controller and the second controller when adjustment to the other one of fiber mass flow rate and dilution water flow rate is being made.

39. A rotary disk pulp refiner control system according to claim 38 wherein the consistency sensor comprises an inline consistency sensor that is located upstream of the refiner from which stock consistency is derived before the stock enters the refining zone of the refiner.

40. A rotary disk pulp refiner control system according to claim 39 wherein the processor is configured to release the controller when or after (i) a first plurality of iterations of the process variable while the controller is paused produce a slope that changes less than a predetermined percent relative to a second plurality of iterations of the process variables while the controller is paused, or (ii) a variance in the average of at least three successive iterations of the process variable while the controller is paused is less than a predetermined tolerance.

41. A rotary disk pulp refiner control system according to claim 40 further comprising a feed screw drive motor whose speed can be changed to change the flow rate of fiber to the refiner, a dilution water pump whose operation can be changed to change the dilution water flow rate, and at least one of a temperature sensor, pressure sensor, an electrical sensor arrangement from which refiner energy, power or motor load is obtainable, a refiner disk gap sensor, and a load or force sensor, and wherein (1) the processor is configured with a controller, (2) the process variable comprises one of a refining zone temperature, refining zone pressure, a refiner inlet stock temperature, a refiner outlet stock temperature, a refiner inlet stock pressure, a refiner stock outlet pressure, refiner energy, refiner power, refiner motor load, gap between the refiner disks, refiner plate force, hydraulic load, energy input and consistency, (3) the control signal affects the flow rate of fiber to the refiner by changing the speed of the feed screw drive motor, and (4) the control signal affects the dilution water flow rate by changing the speed of the dilution water pump.

42. A control system for a rotary disk pulp refiner that has a refining zone between a pair of opposed refiner disks, each refiner disk equipped with a refining surface, between which a flow of stock of fibrous slurry passes during refiner operation, the refiner control system comprising:

at least one temperature or pressure sensing element disposed in the vicinity of the refining zone;

a processor configured to (a) obtain a temperature or pressure of stock in the refining zone from each of the at least one temperature or pressure sensing element, (b) determine a consistency of stock in the refining zone therefrom during refiner operation; and (b) thereafter affect some aspect of refiner operation in response thereto or cause some aspect of refiner operation to be affected in response thereto; and wherein the at least one sensing element comprises a temperature sensing element that outputs a signal representative of a temperature of stock in the refining zone, and the processor comprises a controller that includes a proportional control component and an integral component with the controller having a controller gain of between 0.25 and 2, a time constant of between 0.3 and 1.1 minutes, pausing when or after an adjustment has been made to at least one of the feed screw speed and the dilution water flow rate until a steady-state condition is achieved, and releasing after achieving steady-state condition.

43. A control system for a pulp refiner that has a refining zone between a pair of opposed refiner disks, each refiner disk equipped with a refining surface, between which a flow of stock of fibrous slurry passes during refiner operation, the refiner control system comprising:

a plurality of pairs of spaced apart temperature sensor assemblies disposed in a refining surface of one of the refiner disks with each sensor assembly having a temperature sensing element disposed below a top edge of an adjacent refiner bar of the refining surface and disposed above a bottom of an adjacent groove in the refining surface;

a processor configured to (a) communicate with the plurality of pairs of temperature sensing elements from which at least one temperature of stock in the refining zone during refiner operation is determined, (b) output a control signal that controls at least one of(i) a flow rate of fiber to the refiner and (ii) a flow rate of dilution water added to stock entering the refiner, (c) compare the at least one temperature of stock in the refining zone to a threshold, (d) adjust at least one of the fiber flow rate and the dilution water flow rate if the at least one temperature of stock in the refining zone moves outside of the threshold, (e) pause further adjustment for a period of time, and (f) thereafter resume executing (a) through (f).

44. A refiner control system according to claim 43 wherein each one of the temperature sensing assemblies comprises a metallic housing that carries one of the sensing elements, each sensing element comprises a thermocouple, and the processor comprises an offsite computer that is remotely linked to a distributed control system of a pulp processing facility in which the refiner is located, the distributed control system is linked to a feed screw motor such that it can change the speed thereof in response to a first control signal received from the offsite computer to change the fiber flow rate and the distributed control system is linked to a dilution water pump such that it can change the output thereof in response to a second control signal received from the offsite computer.

45. A control system for a plurality of pairs of pulp refiners that each have a refining zone between a pair of opposed refiner disks, each refiner disk equipped with a refining surface, between which a flow of stock slurry containing fibrous matter passes during refiner operation, the refiner control system comprising:

a plurality of pairs of spaced apart sensor assemblies disposed in a refining surface of one of the refiner disks of each one of the refiners with each sensor assembly having a housing disposed in a pocket in the refining surface that carries a sensing element that is located below a top edge of an adjacent refiner bar of the refining surface and located above a bottom of an adjacent groove in the refining surface with the sensing element providing an output from which a value relating to a physical characteristic of stock in the refining zone is obtainable;

a processor (a) configured to communicate with the plurality of pairs of sensing elements of each one of the plurality of pairs of refiners from which at least one value relating to a physical characteristic of stock in the refining zone is obtained using a set of prestored calibration data for the corresponding plurality of pairs of sensing elements being communicated therewith, (b) configured with a controller comprised of a proportional component and an integral component that (i) compares the at least one value to a setpoint value or to bands above and below the setpoint value, and (ii) provides an output that causes the rate of stock entering the corresponding refiner to change if the at least one value is not equal to the setpoint value or diverges beyond one of the setpoint bands; (c) configured to pause the controller until the at least one value relating reaches a steady-state condition for a period where at least two values obtained while the controller is paused, (d) configured to release the controller when or after steady-state is reached, and (e) configured to set the setpoint to the at least one value when steady-state was reached.

46. A pulp refiner control system according to claim 43 wherein the sensing elements comprise temperature sensing elements from which at least one value relating to a temperature of stock in the refining zone is obtained, the controller comprises a PI controller, the processor is configured to (i) increase the mass flow rate of fibrous matter entering the corresponding refiner if the at least one value is less than the setpoint or falls below the lower setpoint band, and (ii) decrease the mass flow rate of fibrous matter if the at least one value is greater than the setpoint or falls above the upper setpoint band, and wherein a steady state condition occurs when the slope between at least two successive values changes less than five percent or the variance in the average of the at least two successive values falls within a predetermined tolerance.

47. A pulp refiner control system according to claim 45 wherein the sensing elements for each refiner include at least one temperature sensing element and at least one pressure sensing element.

48. A control system for a pulp refiner that has a refining zone between a pair of opposed refiner disks, each refiner disk equipped with a refining surface, between which a flow of stock of fibrous slurry passes during refiner operation, the refiner control system comprising:

at least one pressure or temperature sensing element disposed in the vicinity of the refining surface of one of the refiner disks providing at least one temperature or pressure of stock in the refining zone; and a processor (a) comprising a controller having a proportional component, an integral component, a controller gain of between 0.25 and 2, and a time constant of between 0.3 and 1.1 minutes, (b) configured to obtain a temperature or pressure of stock within the refining zone during refiner operation, (c) configured to affect one of the rate of fibrous matter and the water entering the refiner if the obtained temperature or pressure diverges from a predetermined setpoint or diverges beyond a predetermined range thereof, (d) configured to pause after affecting one of the rate of fibrous matter or water entering the refiner, and (e) thereafter configured to resume (c) through (e).

49. A pulp refiner control system according to claim 48 wherein the processor obtains a temperature or pressure of stock in real time during refiner operation, wherein the processor is configured to affect the rate of fibrous matter entering the refiner by causing a fibrous matter metering conveyor that delivers fibrous matter to the refiner to change speed or by causing a pump that provides water to the refiner to change speed, and wherein the processor is configured to halt further affecting one of the rate of fibrous matter or water entering the refiner by pausing until a plurality of successive measurements of temperature or pressure reach a steady-state condition before resuming (b) through (d).

50. A pulp refiner control system according to claim 48 further comprising a distributed control system located onsite, a first computer that comprises the processor, and a second computer remotely located offsite and linked to the first computer, and wherein the first computer is linked to the distributed control system and configured to output a signal to the distributed control system that causes the distributed control system to change at least one of the fiber mass flow rate of fibrous matter entering the refiner and the flow rate of dilution water entering the refiner.

51. A pulp refiner control system according to claim 48 wherein the processor is configured to selectively change the rate of fibrous matter entering the refiner by changing the speed of a fibrous matter metering conveyor or to selectively change the rate of water entering the refiner by changing the speed of a pump that delivers the water to the refiner, and wherein the processor is configured to resume (b) through (d) when a plurality of successive temperatures or pressures obtained during the pause change in slope less than five percent or reach a variance in average temperature or average pressure that falls within a predetermined tolerance.

* * * * *